US006797369B2

(12) United States Patent
Usami et al.

(10) Patent No.: US 6,797,369 B2
(45) Date of Patent: Sep. 28, 2004

(54) CEMENTED CARBIDE AND CUTTING TOOL

(75) Inventors: Keiji Usami, Kagoshima (JP); Daisuke Shibata, Kagoshima (JP); Hiroshi Ohata, Kagoshima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 10/256,275

(22) Filed: Sep. 26, 2002

(65) Prior Publication Data

US 2003/0129456 A1 Jul. 10, 2003

(30) Foreign Application Priority Data

Sep. 26, 2001 (JP) ..... 2001-293032
Sep. 26, 2001 (JP) ..... 2001-293033
Sep. 27, 2001 (JP) ..... 2001-298672
Oct. 19, 2001 (JP) ..... 2001-322148

(51) Int. Cl.[7] ..... B23B 27/14

(52) U.S. Cl. ..... 428/217; 75/240; 75/241; 75/242; 428/212; 428/325; 428/336; 428/698

(58) Field of Search ..... 75/243, 245, 240, 75/241, 242; 428/698, 336, 212, 217, 325; 51/307, 309

(56) References Cited

U.S. PATENT DOCUMENTS 399,954 A * 3/1889 Kolaska et al. ..... 607/149
3,779,745 A * 12/1973 Rudy ..... 420/431
4,417,922 A * 11/1983 Hall et al. ..... 75/236
4,698,266 A * 10/1987 Buljan et al. ..... 428/457
4,784,923 A * 11/1988 Graham ..... 428/698
5,059,491 A * 10/1991 Odani et al. ..... 428/614
5,296,016 A * 3/1994 Yoshimura et al. ..... 75/238
5,447,549 A * 9/1995 Yoshimura ..... 75/238
5,580,666 A * 12/1996 Dubensky et al. ..... 428/552
5,856,626 A * 1/1999 Fischer et al. ..... 75/240
6,207,262 B1 * 3/2001 Ichikawa et al. ..... 428/216
6,235,382 B1 * 5/2001 Matsubara ..... 428/325
6,506,226 B1 * 1/2003 Chen et al. ..... 75/237

FOREIGN PATENT DOCUMENTS

JP 06-093473 4/1994
JP 10225804 * 8/1998
JP 10287947 * 10/1998
JP 11277304 * 10/1999

* cited by examiner

*Primary Examiner*—Archene Turner
(74) *Attorney, Agent, or Firm*—Hogan & Hartson, LLP

(57) ABSTRACT

There is provided a cemented carbide comprising a hard phase component which comprises a tungsten carbide (WC) and at least one selected from carbides, nitrides and carbonitrides of metals of the groups 4a, 5a and 6a in the periodic table; and a binder phase component comprising at least one of iron-group metals, wherein the surface region of the cemented carbide has 90–98% of the minimum hardness as compared with internal hardness, thereby having high hardness and toughness which is suitable to using as a cutting tool.

17 Claims, 5 Drawing Sheets

CEMENTED CARBIDE AND CUTTING TOOL

FIELD OF THE INVENTION

This invention relates to a cemented carbide and a cutting tool using a cemented carbide, and more particularly to a cemented carbide and a cutting tool having a hardness and a toughness suitable for cutting of a hardly machinable material such as a stainless steel, besides a steel and cast iron, such as a carbon steel and an alloy steel, and further excelled in a wear resistance.

BACKGROUND OF THE INVENTION

As a cemented carbide widely used for cutting of metal, a WC Co alloy which is composed of a hard phase wherein tungsten carbide WC is a main component, and a binder phase of iron-group metals, such as cobalt), or an alloy wherein a carbide, a nitride, a carbonitride, etc. of metals of groups 4a, 5a, or 6a in the periodic-table were further added to the WC-Co is known.

Generally, as a method of manufacturing this cemented carbide, a method comprising the steps of: grinding, mixing and molding a raw material powder which constitutes the above cemented carbide, and sintering at 1350–1600° C. for about 1 to 3 hours, is known.

These cemented carbide is mainly applied to cutting of a cast iron, a carbon steel, etc. as a cutting tool. Recently, as for a cemented carbide, application to cutting of a hardly machinable material represented by stainless steel is also considered.

However, since such a cutting difficult material has characters such as generation of work hardening, high affinity with tool material and low thermal conductivity, many problems has generated in the field of cutting. That is, a cemented carbide which has toughness and hardness is needed for processing of a stainless steel.

When cutting of the hardly machinable material, such as a stainless steel, is carried out with a cutting tool made from K-grade cemented carbide which is composed of WC-Co system cemented carbide specified to JIS B 4053 (1996) which is comparatively few amounts of Co, or a cutting tool made from P-grade cemented carbide which has B1 type (cubic type) solid solution of single composition, wear or a cutting tool progresses rapidly, or a fracture whose welding is considered to be a cause is generated, a processing surface state of cutting material gets worse. As a result, it becomes a tool life for a short time, and good cutting can not be performed.

Moreover, a damage to primary notch parts with a cutting force received from a processing surface which carried out work hardening is intense, and it results in a tool life immediately, and comes to acquire good cutting characteristics.

Furthermore, a conventional cemented carbide contains an iron (Fe) and a chromium (Cr) as an impurity. When such a cemented carbide is used as a cutting tool, Fe and Cr combine with a large amount of an iron (Fe) and chromium (Cr) which are contained in a workpiece of which a temperature was raised during cutting. As a result, welding or agglutination of the workpiece to the cutting tool surface is carried out, and action parts (piece edge etc.) are unusually worn out, or a cutting force is increased, whereby it becomes easy to generate damage on a cutting tool surface.

Moreover, there was a problem that a finished-surface coarseness of a surface to be cut deteriorates by an unevenness of a welding thing or an agglutination thing.

An iron (Fe) and a chromium (Cr) in are contained in a primary raw material as an unescapable impurity, or are contained in the cemented carbide during a manufacturing process, and cannot be perfectly removed on industry. Moreover, a content of iron (Fe) and chromium (Cr) which are contained during a manufacturing process is uncontrollable, since it is changeable in connection with change or process and surface states of a grinder or the like.

Moreover, since iron has high affinity with carbon, if a content of iron (Fe) in a surface of the cemented carbide is large, carbon and iron (Fe) combine preferentially, in coating a hard coat by vapor phase synthetic methods, such as CVD and PVD. Accordingly, it become easy to generate embrittlement phases, such as η phase, to an interface of the cemented carbide and the hard coat, and an adherence strength or a hard coat falls. Consequently, the hard coat is exfoliated and destroyed, or a life falls in using as cutting tool or slide member.

In order to improve a wear resistance, a method of coating a hard coating of higher hardness on an alloy surface is known. In order to relax an impact to the hard coating, the method of forming the so-called β-free layer wherein a content of B-1 type solid solution is reduced, to a surface area to which a hard coating of the cemented carbide is formed is known.

Furthermore, Japanese Unexamined Patent Publication No. 6-93473 discloses that a content of Zr existing in a depth region of 1–50 μm from a base material surface to insides is disappeared or decreased, when using Ti and Zr as a B-1 type solid solution (without using Nb).

However, it is known that when surfaces of these cemented carbides are oxidized and deteriorated with a heat at the time of cutting and oxygen in environment, its hardness and toughness fall. For this reason, even when a hard coating is coated on an alloy surface, an alloy surface may be exposed to an oxidizing atmosphere by existence of a defective portion in a hard coating. Especially, if a β-free layer is formed in an alloy surface (that is, $p_{1suf}/p_{in}<0.9$, and $q_{1suf}/q_{in}<0.9$, each sign of which is defined as an after-mentioned), it will be easy to generate oxidization and deterioration of an alloy surface.

On the other hand, when not forming a β-free layer directly under a hard coating ($p_{1suf}=p_{2suf}=p_{in}$, $q_{1suf}=q_{2suf}=q_{in}$, each sign of which is defined as an after-mentioned), the shock resistance and fracture resistance of the hard coating will fall.

Furthermore, like a coating cemented carbide disclosed in Japanese Unexamined Patent Publication No. 6-93473, when there are few contents of Zr in a surface region of a base material ($q_{1suf}/q_{in}<0.9$, each sign of which is defined as an after-mentioned), plastic deformation resistance worsens and wear resistance falls.

SUMMARY OF THE INVENTION

A main object of this invention is to provide a cemented carbide which has high hardness and a toughness.

Other object of this invention is to provide a cemented carbide that welding and adhesion with workpiece in the time of cutting and sliding etc. can be inhibited, and a good hard coat layer can also be formed.

Other object of this invention is to provide a surface coating cemented carbide which is excellent in oxidation resistance while having high hardness and high toughness, and can improve high fracture resistance and high wear resistance in severe environment as exposed to high temperature by continuation operation etc.

Another object of this invention is to provide a cutting tool which shows excellent wear resistance, plastic deformation resistance, and fracture resistance in case of cutting of a hardly machinable material, such as stainless steel.

(1st Cemented Carbide)

Inventors found out the new fact that when providing, in cemented carbide, the surface region of 90–98% of the minimum hardness as compared with the hardness in an inside, a cemented carbide, which has hardness sufficient to processing of a hardly machinable material, and which has toughness being capable of bearing the impact starting in the time of cutting the surface from which work hardening was started, was obtained.

Moreover, inventors found out that the new fact that, when (1) two or more B1 type solid solution phases exist in cemented carbide, (2) at least one this B1 type solid solution phase is B1 type solid solution phase with high contents of Zr, as compared with other B1 type solid solution phases; and (3) existence states differs in the inside near the surface of the cemented carbide, the above-mentioned effects are acquired characteristic.

That is, the 1st cemented carbide of this invention is composed of a hard phase component which comprises a tungsten carbide WC and at least one selected from carbides, nitrides and carbonitrides of metals of the groups 4a, 5a and 6a in the Periodic Table; and a binder phase component comprising at least one iron-group metals, wherein the surface region of this cemented carbide has 90–98% of the minimum hardness as compared with internal hardness.

The 1st cemented carbide of this invention contains Zr as a metal selected from the groups 4a, 5a and 6a in the Periodic Table. The ratio of Zr in metals of the groups 4a, 5a and 6a in the Periodic Table has a high region near the surface as compared with the inside of the cemented carbide. Further, the thickness of the area wherein the content ratio of Zr is high as compared with the inside of the cemented carbide may be 5 to 100 $\mu$m.

Two or more B1 type solid solution phases may exist in the cemented carbide, and one of them is B1 type solid solution phase with high contents of Zr as comparing with other B1 type solid solution phases.

The mean particle diameter of B1 type solid solution phase with high contents of Zr may be 3 $\mu$m or less.

When the content of Ta among metals of the groups 4a, 5a and 6a in the Periodic Table is 1% by weight or less in TaC conversion in the whole quantity, the cemented carbide having good tool characteristics is obtained.

The 1st cutting tool of this invention is composed of the 1st cemented carbide mentioned above, or is composed of the 1st cemented carbide and a coating, as mentioned later, on the surface of the 1st cemented carbide.

A coating may be composed of at least one selected from metal carbide, metal nitride, metal carbonitride, TiAlN, TiZrN, TiCrN, a diamond and Al2O3. The above-mentioned metal is selected from the groups 4a, 5a and 6a in the Periodic Table. The coating is a single layer or two or more layers.

(2nd Cemented Carbide)

Inventors found out the following facts. That is, in a cemented carbide containing a WC phase and a binder phase of a iron-group metal, at least two solid solution phases selected from carbides, nitrides, and carbonitrides of metals of the groups 4a, 5a and 6a in the Periodic Table and containing Zr and Nb at least, are precipitated. Further, the cemented carbide has the 1st phase having a peak in 2θ=40.00–41.99° and the 2nd phase having a peak in 2θ=38.00–39.99° in the X-ray diffraction of the cemented carbide. As a result, hardness and high temperature strength of the cemented carbide can be raised.

A cutting tool obtained by using the cemented carbide of this invention has wear resistance, plastic deformation resistance, and fracture resistance which were excellent in cutting of hardly machinable material, such as stainless steel, and high efficiency cutting is attained.

That is, the 2nd cemented carbide of this invention comprises a WC phase, at least two solid solution selected from carbides, nitrides and carbonitrides of metals of the groups 4a, 5a and 6a in the Periodic Table and containing Zr and Nb at least, and a binder phase containing at least one iron-group metal, wherein the cemented carbide has the 1st phase having a peak in 2θ=40.00–41.99° and the 2nd phase having a peak in 2θ=38.00–39.99° in the X-ray diffraction of the cemented carbide.

Here, it is desirable that the ratio (p2/p1) of strength (p1) of the 1st peak, and strength (p2) of the 2nd peak is 0.1–2. The content ratio (Zr/Zr+Nb) of Zr and Nb may be 0.5–0.7. The cemented carbide having the surface region of p2>0 and p1=0 shows toughness and the excellent fracture resistance.

Even when a Ta content is 1% by weight or less in TaC conversion in the whole quantity of the metals of the 4a, 5a and 6a groups of the Periodic Table, the cemented carbide which has excellent tool characteristics is obtained.

Furthermore, it is desirable to contain the WC phase at the ratio of 60–95 volume %, and to contain the binder phase at the ratio of 1–20 volume %.

Moreover, as for the cutting tool which consists of the above cemented carbide, it is especially desirable to comprise such cemented carbide and at least one coating selected from the group consisting of metal carbide, metal nitride, metal carbonitride, TiAlN, TiZrN, TiCrN, diamond and $Al_2O_3$ and provided on the surface of the cemented carbide. The above-mentioned metal is selected from the 4a, 5a and 6a groups of the Periodic Table. The coating is a single layer or two or more layers.

(3rd Cemented Carbide)

Inventors found out the facts that in order to inhibit the influence of iron (Fe) and chromium (Cr) to workpiece, it is effective to control the content of iron (Fe) and chromium (Cr) in cemented carbide, and to reduce the content ratio of iron (Fe) and chromium (Cr) to the cobalt (Co) and/or nickel (NI) in the surface of the cemented carbide than that in the inside of the cemented carbide. Accordingly, welding and adhesion with workpiece can be inhibited, and in case that a hard coat is formed, the cemented carbide coated with a good hard coat is obtained That is, the 3rd cemented carbide of this invention comprise 2 to 20% by weight of a binder metal comprising cobalt (Co) and/or nickel (nickel), 0 to 30% by weight of at least one selected from carbides, nitrides and carbonitrides of metals of the groups 4a, 5a and 6a in the Periodic Table, 10 to 300 ppm of iron (Fe), 100~1000 ppm of chromium and tungsten carbide and unescapable impurities as remainder, wherein a surface region satisfies the conditions of $p_{suf}<p_{in}$, wherein $p_{suf}$ and $p_{in}$ are defined below.

$p_{in}=w_{2\,in}/w_{1\,in}$ $p_{suf}=w_{2\,suf}/w_{1suf}$ $w_{1in}$: a content of the binder metal inside the cemented carbide $w_{2in}$: a content of Fe and Cr inside the cemented carbide $w_{2suf}$: a content of the binder metal in the surface region of the cemented carbide $w_{1suf}$: a content of Fe and Cr in the surface region of the cemented carbide The maximums of the ratio ($p_{out}/p_{in}$) of $p_{suf}$ and $p_{in}$ in the surface region may be 0.5 to 0.95. The thickness of the surface region may be 1 to 20 $\mu$m.

It is desirable to cover with the total thickness or 1–30 μm at least one layer of the hard coats which consist of at least one selected from metal carbide, metal nitride, metal carbonitride, TiAlN, TiZrN, TiCrN, DLC (diamond-like carbon), diamond and $Al_2O_3$ on the surface of cemented carbide. The above-mentioned metal is selected from the 4a, 5a, and 6a groups in the Periodic Table.

The method of manufacturing the 3rd cemented carbide is composed of steps of:

grinding and mixing the raw materials powder comprising of tungsten carbide powder, at least one powder selected from carbides, nitrides and carbonitrides of metals of the 4a, 5a, and 6a group in the periodic-table, and at least one material of cobalt (Co) and nickel (Ni), molding the resulting mixture, retaining a green body obtained for 0.3 to 2 hours at the 1st sintering temperature of 1350 to 1600° C. in a non-oxidizing atmosphere, cooling to the 2nd sintering temperature lower 20 to 200° C. than the 1st sintering temperature, and retaining at the 2nd sintering temperature in a vacuum for 1 to 3 hours.

It is desirable for portions in contact with raw material powders of a container and a grinding member used in the method of manufacturing the cemented carbide in case the raw material powders are ground and mixed not containing Fe and Cr.

(4th Cemented Carbide)

Inventors found out the facts that, when a 1st surface region and a 2nd surface region provided inside of the 1st surface region as mentioned below are provided to the surface of a cemented carbide, oxidation resistance of the cemented carbide forming a coating can be raised, in addition to raising toughness of the surface of the cemented carbide and raising fracture resistance of a hard coating. Accordingly, in case of operating continuously or intermittently for a long time, thereby exposing to high temperature for a long time, a surface coating cemented carbide has excellent fracture resistance and wear resistance.

(1) 1st surface region wherein the content ration of Zr is nearly equal to that of inside, and the content ratio of metallic elements M which is at least one selected from metals of the groups 4a, 5a and 6a in the periodic table, except for Zr, is low as compared with inside.

(2) 2nd surface region wherein the content ratio of Zr is nearly equal to that of inside, and content ratio of metallic elements M which is at least one selected from metals of the groups 4a, 5a and 6a in the periodic-table, except for Zr, is low as compared with inside.

That is, a surface coated cemented carbide of this invention is composed of a cemented carbide which comprises WC, at least one carbide, nitride and carbonitride of metallic element M which selects from metals of the group 4a, 5a and 6a in the periodic-table, and a binder material of iron-group metal, wherein metallic element M contains Zr and Nb, and the 1st surface region and the 2nd surface region which satisfy the relation shown below are provided within a region of depth of 5 to 200 μm from the surface.

$$0.1 \leqq q_{1suf}/q_{in} \leqq 0.9$$

$$0.9 \leqq r_{1\ suf}/r_{in} \leqq 1.1$$

$$1.1 \leqq q_{2\ suf}/q_{in} \leqq 1.5$$

$$0.9 \leqq r_{2\ suf}/r_{in} \leqq 1.1$$

$$q_{in}=M_{in}/T_{in}$$

$$q_{1suf}32\ M_{1suf}/T_{1suf}$$

$$q_{2suf}=M_{2suf}/T_{2suf}$$

$$r_{in}=Zr_{in}/T_{in}$$

$$r_{1suf}=Zr_{1\ suf}/T_{1suf}$$

$$r_{2suf}=Zr_{2\ suf}/T_{2suf}$$

$M_{in}$: Content ratio of metallic element M in the inside of the cemented carbide $Zr_{in}$: Content ratio of Zr in the inside of the cemented carbide $T_{in}$: Content ratio of W in the inside of the cemented carbide $M_{1suf}$: Content ratio of metallic element M in the 1st surface region of the cemented carbide $Zr_{1suf}$: Conyent ratio of Zr in the 1st surface region of the cemented carbide $T_{1suf}$: Content ratio of W in the 1st surface region of the cemented carbide $M_{2suf}$: Content ratio of metallic element M in the 2nd surface region of the cemented carbide $Zr_{2suf}$: Content ratio of Zr in the 2nd surface region of the cemented carbide $T_{2suf}$: Content ratio of W in the 2nd surface region of the cemented carbide It is desirable that the oxidation resistance of the surface coating cemented carbide is 0.01 mg/mm$^2$ or less.

It is desirable that metallic element M satisfies the following relation in the whole cemented carbide.

$$0.1 \leqq Zr/(Ti+Zr+Hf) \leqq 0.5,$$

$$0.6 \leqq Nb/(V+Nb+Ta) \leqq 1.0, \text{ and}$$

$$0.05 \leqq Zr/(Zr+Nb) \leqq 0.8.$$

Furthermore, it is desirable that the cemented carbide contains 0.1 to 1.5% by weight of ZrC, 0.5 to 3.5% by weight of NbC, 1.0 to 2.5% by weight of TiC, 0 to 1.0% by weight of TaC, 0 to 1.0% by weight of HfC, 0 to 1.0% by weight of $Cr_3C_2$, 0 to 1.0% by weight of VC, and 5 to 10% by weight of Co, and the residue consists of WC and unescapable impurities.

The thickness $d_2$ of the 1st surface region may be 1–50 μm, and the thickness $d_2$ of the 2nd surface region may be 10–200 μm.

Furthermore, the hard coating may be at least one layers selected from metal carbide, metal nitride, metal oxide, metal carbonitride, metal carbonation thing, metal nitride oxide, metal carbonated-nitride, and diamond. It is suitable that the above metal is selected from metals or the group 4a, 5a and 6a metal in the periodic-table, or aluminum.

DETAILED EXPLANATION OF THE INVENTION (1st Cemented Carbide)

This cemented carbide consists of a hard phase and a binder phase. The hard phase consists of 100 to 85% by weight of WC, and 0 to 15% by weight of carbides, nitrides, or carbonitrides of metals of the group 4a, 5a and 6a in the periodic-table. B1 type solid solution phase formed in case that materials other than WC are blended as hard phase materias consists of a carbide solid solution composite or a carbonitride solid solution composite. The binder phase contains iron-group metals, such as Co, as a main component, and is contained at 5–15% by weight of the whole quantity.

The cemented carbide in this invention has the surface region of 90–98% of the minimum hardness as compared with the hardness in an inside. Here, the "minimum hardness" is defined as a value that hardness serves as a minimum, when hardness is measured for every depth toward an inside from a surface of a cemented carbide and a relation with a hardness in a depth and its depth from a surface is plotted in a graph (refer to FIG. 1). However, in this invention, a hardness of each depth means an average hardness about arbitrary 10 points in the certain depth, and an internal hardness means hardness in a depth of 1 mm from the surface.

If hardness of the surface region of cemented carbide is less than 90% as compared with internal hardness, hardness will fall remarkably by the rise of the cutting temperature at the time of hardly machinable material processing, and a composition deformation of the edge of a blade will be generated. If hardness of the surface region exceeds 98%, since the surface becomes too hard, in vase that stainless steel which carried out work hardening is cut, fractures will be produced, without ability bearing an impact.

Therefore, the hardness of a surface region must be set to 90 to 98% of internal hardness.

Figure 1:
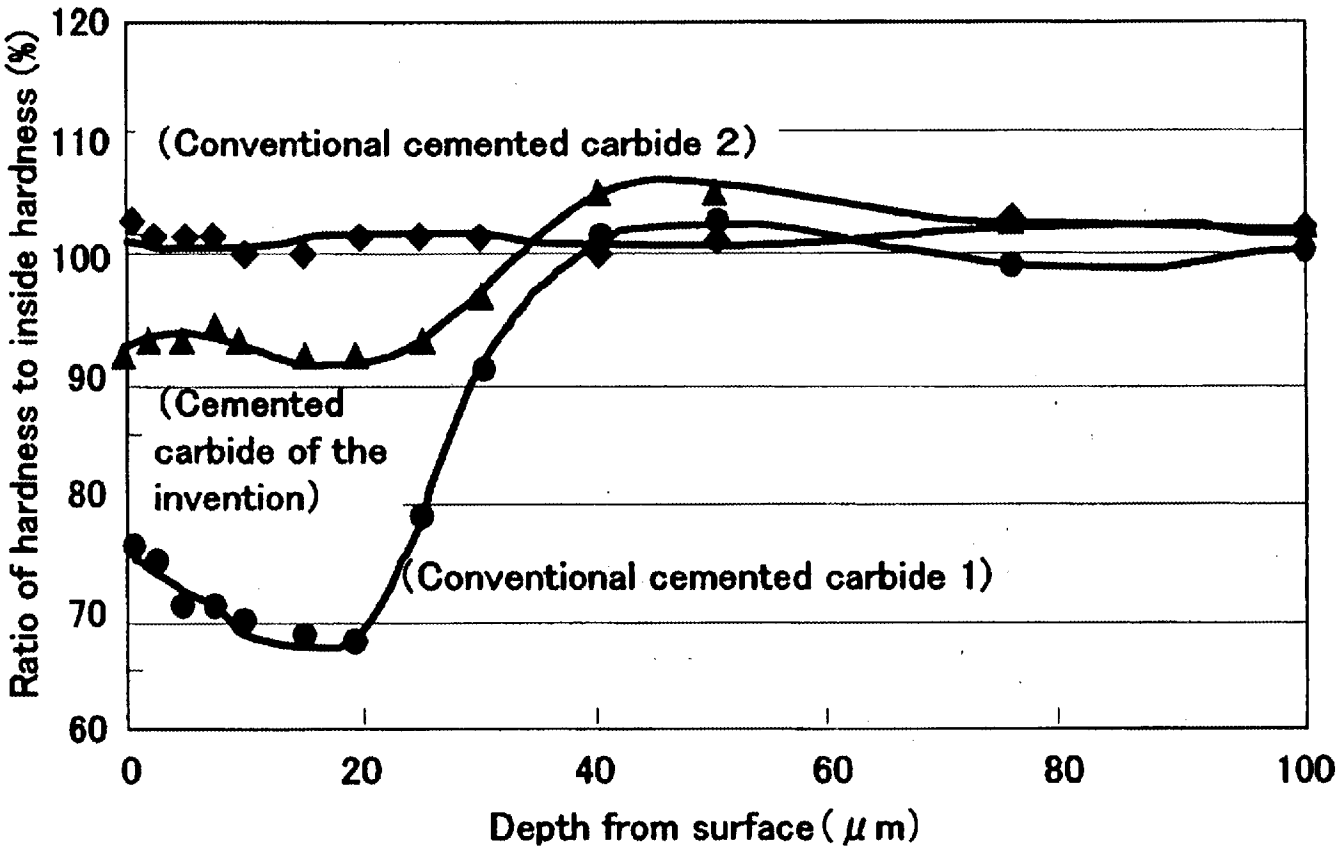
FIG. 1 is a graph showing hardness inclination inside in the 1st cemented carbide of this invention and conventional cemented carbide.

The hardness inclination of the cemented carbide in this invention and conventional cemented carbide are shown in FIG. 1. Conventionally, in β-free layer generated by nitride or nitrogen addition which is known as the technique of surface toughening of cemented carbide, the minimum hardness of the surface layer which toughened is about 50 to 80% as comparing with the hardness in an inside. Thus, since a cutting temperature rose remarkably in cutting of hardly machinable material, hardly machinable material is softened and composition deformation is produced. On the other hand, according to the cemented carbide of this invention, surface toughening is performed without nitrogen addition. Therefore, toughness near the surface is attained in the cutting temperature rise region in cutting of hardly machinable material, retaining sufficient hardness for cutting.

Figure 2:
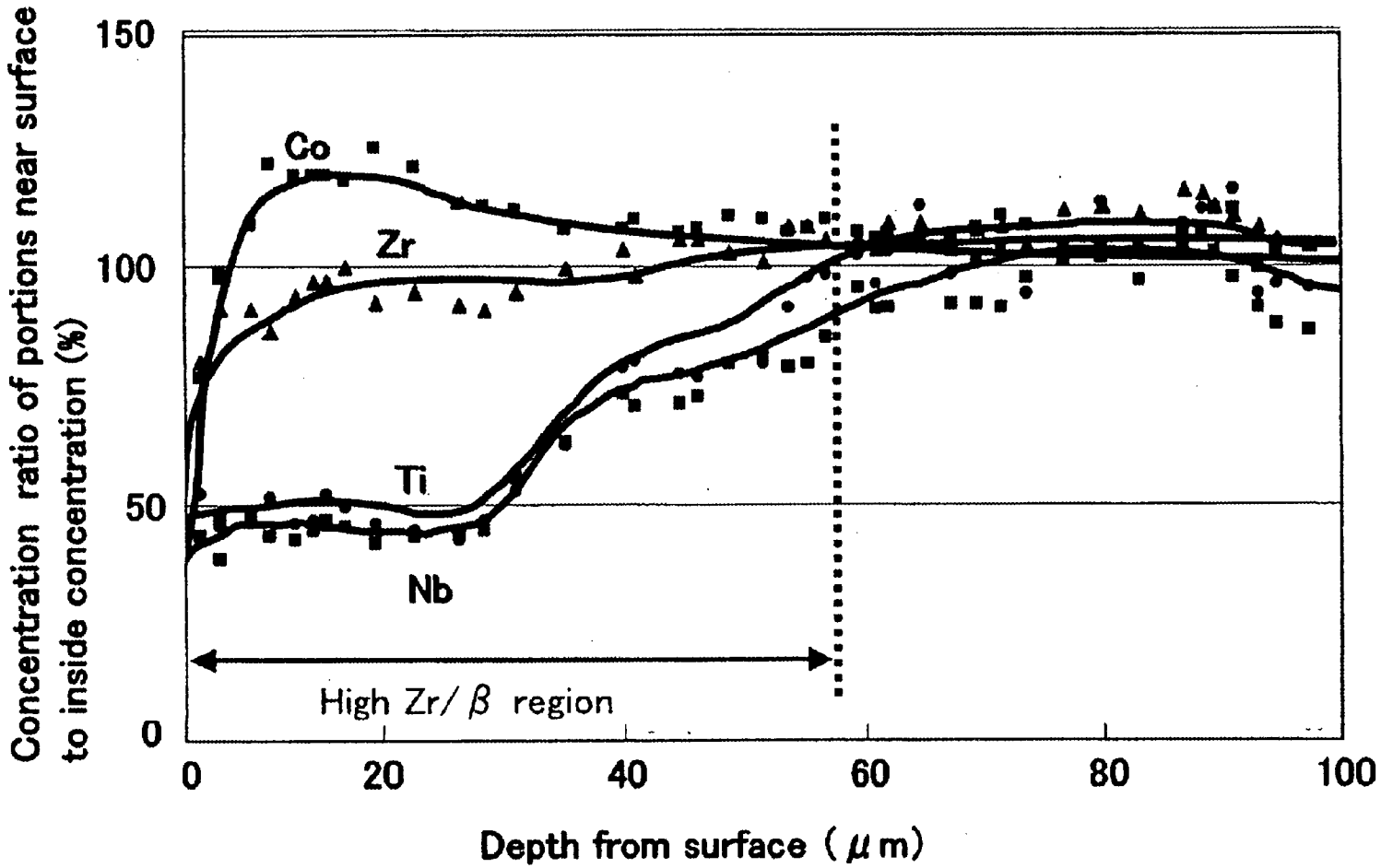
FIG. 2 is a graph showing the element distribution in the 1st cemented carbide of this invention.

As shown in metallic element distributions of FIG. 2, the cemented carbide of this invention has, to the surface portion, a region that the ratio of Zr occupied to metals selected from the group 4a, 5a and 6a in the periodic-table is high as compared with the inside of cemented carbide. Since strength in high temperature is improved further, the surface region toughened has excellent fracture resistance. It is a prime factor that Zr excels in toughness and plastic deformation resistance in high temperature.

Moreover, in a surface region, many of metals of the groups 4a, 5a, and 6a in the periodic-table except for Zr reduce quantity, and the quantity of a binder phase increases corresponding to this. Increase in quantity of this binder phase contributes to enhancement of toughness. Furthermore, in relation with wear resistance, the binder phase of the loading part does not have a bad influence on plastic deformation resistance by incorporating some amounts of metals of the groups 4a, 5a, and 6a periodic-table. Therefore, according to the cemented carbide of this invention, wear resistance is also improved by the excellent plastic deformation resistance of Zr in high temperature.

As shown in FIG. 2, it is suitable that a surface region wherein the ratio of Zr occupied in the metals selected from the groups 4a, 5a, and 6a in the periodic-table is high as compared with the inside of cemented carbide has the thickness of 5 to 100 μm toward an inside from the surface. If the thickness of the surface region that the ratio of Zr is high as compared with the inside of cemented carbide is less than 5 μm, strength becomes inadequate. Therefore, plastic deformation and damage on a tool become intense. Conversely, when exceeding 100 μm, there is a possibility that wear resistance falls and the increase in the amount of tool wears may become remarkable.

In the cemented carbide, two or more of B1 type solid solution phases may exist in an inside, and at least one these may be a B1 type solid solution phase with high Zr contents as compared with other B1 type solid solution phases. Hence, the excellent plastic deformation resistance in high temperature is obtained, and wear resistance is improved. That is, composition of B1 type solid solution phase is changed with formation of a solid solution phase with high Zr contents, and wettability with a binder phase is improved, whereby the cemented carbide is strengthened as a whole. Therefore, the cemented carbide retains the mechanical strength in high temperature by making these B1 type solid solution phases exist moderately, thereby having excellent machinability in the high speed and high efficiency processing of hardly machinable material.

It is desirable that B1 type solid solution phase with high contents of Zr, exists in the cemented carbide as a phase whose mean particle diameter is 3 μm or less. If a mean particle diameter exceeds 3 μm, the strength of an alloy will fall as a whole, since B1 type solid solution phase has bad wettability with a binder phase. The optimal mean particle diameter is about 1 micrometer. That is, since the solid solution phase itself is originally brittleness, when it deposited as a big and rough phase in an alloy, the fall of the mechanical strength of an alloy is remarkable. Therefore, when it uses as a cutting tool, damage and plastic deformation of a tool become intense. Therefore, it is needed to make B1 type solid solution phase with high Zr contents exist in the mean particle diameter of the above-mentioned range.

Furthermore, according to this invention, a Ta content in metals of the groups 4a, 5a, and 6a in the periodic-table is 1% by weight or less, preferably 0.2% by weight or less by Tac conversion in the whole quantity of cemented carbide. It is more desirable except for Ta containing as an unescapable impurity not to contain Ta substantially. Hence, the cemented carbide can maintain excellent wear resistance, plastic deformation resistance, and fracture resistance. That is, the cemented carbide which has thermal and mechanical characteristics such as 1400 or more of Vickers hardness (Hv), 12 $MPa/m^{1/2}$ or more of fracture toughness (K1c), 2500 Mpa or more of three-points bending strength, and 70 W/m-K or more of thermal conductivity in 800° C., is obtained, without using very expensive Ta raw material as compared with other raw materials.

As examples of the hard coat layer, carbide, nitride and carbonitride of metals of the groups 4a, 5a and 6a in the periodic-table including TiC, TiN, and TiCN, and further TiAlN, TiZrN, TiCrN, $ZrO_2$, $Al_2O_3$, etc. can be employed. It in desirable that these layers are formed in the thickness of 0.1 to 20 μm by using CVD or PVD.

(Manufacturing Method)

In order to manufacture the cemented carbide mentioned above, first, 80 to 90% by weight of tungsten-carbide powder whose mean particle diameter is, for example, 0.5 to 10 μm; 0.1 to 10% by weight of powder of carbide, nitride and carbonitride of metals selected from the groups 4a, 5a, and 6a in the periodic-table or two or more of solid solution powder of these metals in a total amount whose mean particle diameter is 0.5–10 μm; 5–15% by weight of iron-group metal whose mean particle diameter is 0.5–10 μm; and if needed, metal tungsten (W) powder or carbon black (c) are mixed.

Next, the mixed powder is molded in predetermined form by the well-known methods, such as a press forming, casting, extrusion, and cold isostatic press molding. The cemented carbide mentioned above can be obtained by carrying out the temperature-up of the resulting green body at a velocity of 1 to 20° C./min. under a vacuum of 0.1 to 15 Pa, and sintering it at 1350–1500° C. for 0.5 to 2 hours, preferably for 0.2 to 5 hours.

Here, in order to obtain the cemented carbide which has the surface region of 90–98% of the minimum hardness to a surface region as compared with internal hardness, the amounts of the binder-phase metals, such as Co to the carbide which constitutes the so-called B1 type solid solution, and the amount of C in the healthy two phases area in cemented carbide are adjusted, without adding nitride and/or carbonitride as a primary raw material. Furthermore, it is required to control especially both temperature-up velocity near liquid phase appearance temperature and cooling rate after sintering to about 5° C./min. among sintering conditions. Moreover, the cemented carbide can be more efficiently obtained by performing the hydrogen flow and decarbonization atmosphere sintering in a debinder process.

Furthermore, a cemented carbide which retains wear resistance because of further excellent strength and excellent plastic deformation resistance in high temperature, can be obtained by adjusting the addition ratio of Zr compound to the carbide of metals of the groups 4a, 5a and 6a in the periodic-table which constitutes B1 type solid solution in the primary raw materials of cemented carbide, followed by sintering by the above-mentioned method.

The thickness of the surface region which has the minimum hardness mentioned above is controllable by adjusting the retention temperature and time at the time of sintering.

Since the cemented carbide of this invention mentioned has a mechanical properties and thermal characteristics excellent in hardness, strength, and thermal conductivity in high-temperature, it can be adapted for a mold, an abrasion-proof member, a high temperature structural material, etc., and can be suitably used as a cutting tool, especially stainless steel.

Moreover, the cemented carbide which formed at least one coating selected from metal carbide, metal nitride, metal carbonitride, TiAlN, TiZrN, TiCrN, diamond, and $Al_2O_3$ with the form of a single layer or two or more layers on the surface of the cemented carbide mentioned above can also be suitably used for a cutting tool, etc. Here, the metal is at least one selected from the groups 4a, 5a and 6a in the periodic-table.

In order to form a coating on the cemented carbide, after grinding or washing the surface of cemented carbide by request, well-known thin film formation method such as PVD, CVD, etc. can be conventionally used. It is desirable that the thickness of the coating is 0.1 to 20 μm.

(2nd Cemented Carbide)

This cemented carbide is composed of a WC phase, solid solution phases comprising tow or more of carbide, nitride, and/or carbonitride of metals selected from the group 4a, 5a, and 6a in the periodic-table, which contain Zr and Nb at least, and a binder phase containing at least one iron-group metals.

In this invention, the solid solution phases which contain Zr and Nb is precipitated in cemented carbide. Accordingly, solid dissolution with WC of other carbides, such as TiC, is decreased, whereby especially it becomes both of strength in high temperature and hardness.

This 2nd cemented carbide has a 1st peak which has peak top in 2θ=40.00 to 41.99°, and a 2nd peak which has peak top in 2θ=38.00 to 39.99° at an X-ray diffraction peak.

Figure 3:
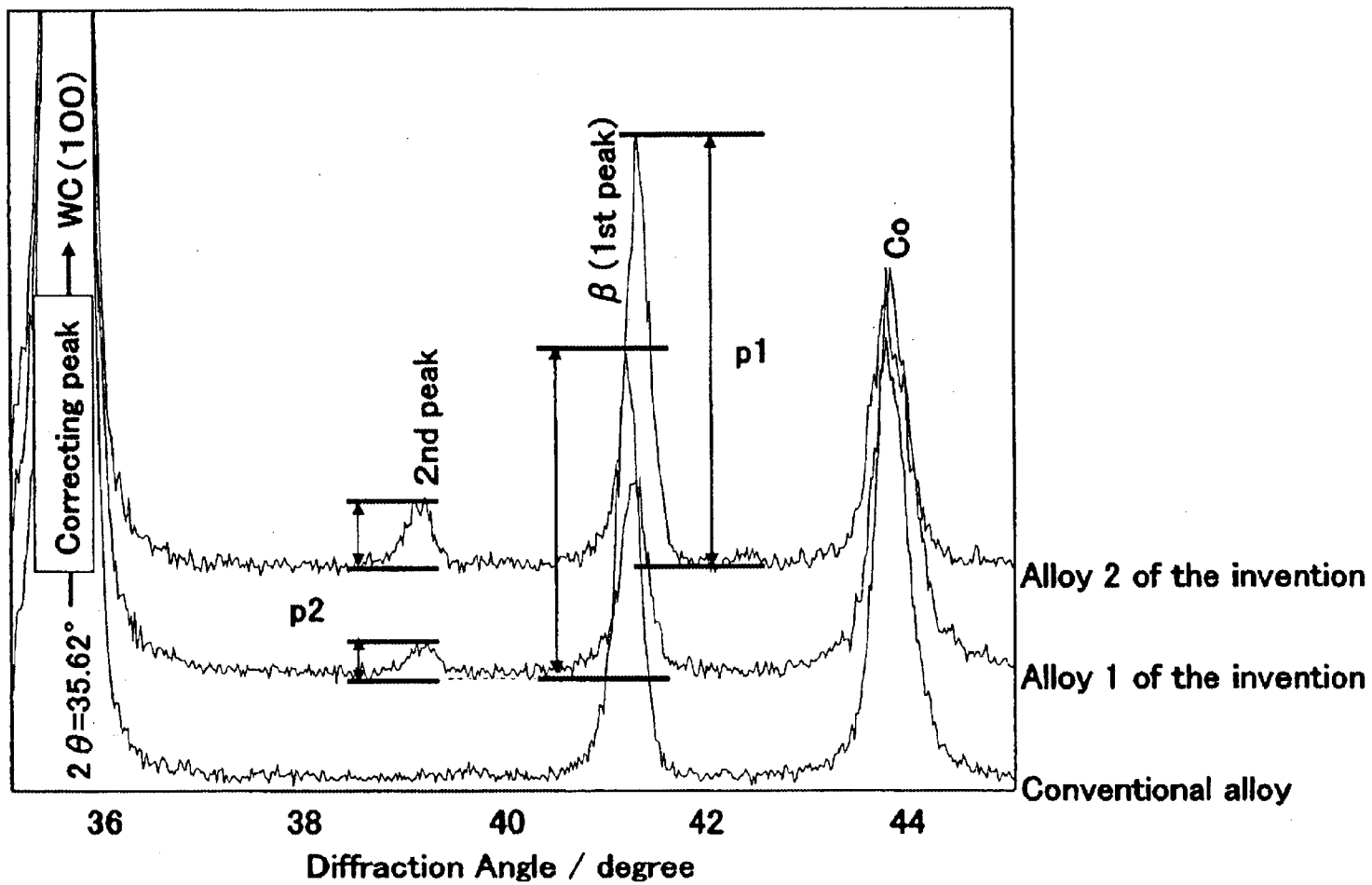
FIG. 3 is a graph showing the X-ray-diffraction-analysis results of the 2nd cemented carbide of this invention and conventional cemented carbide.
Figure 4:
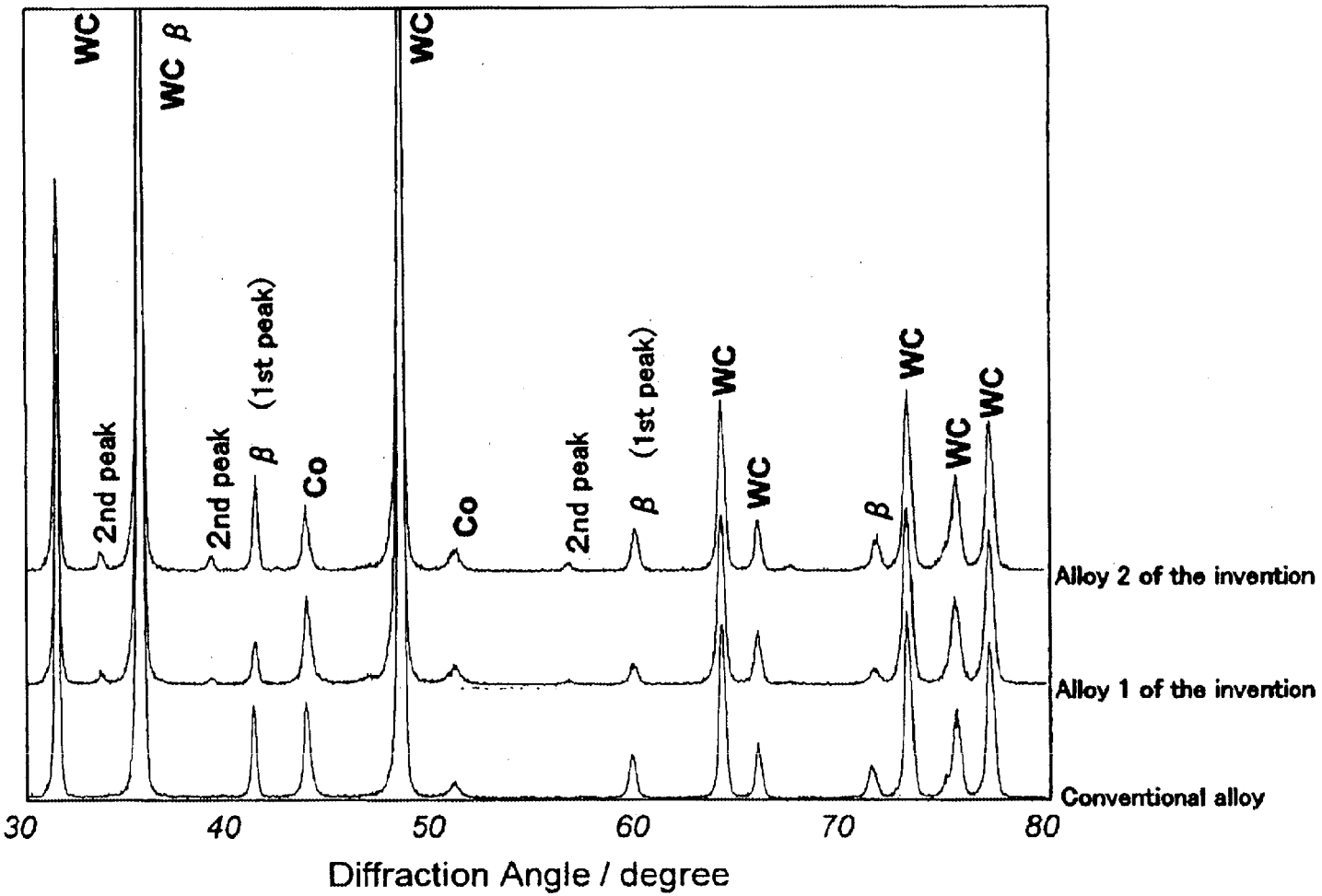
FIG. 4 is graph to which a part to FIG. 3 was expanded.

X-ray diffraction results of the 2nd cemented carbide and conventional cemented carbide are shown in FIGS. 3 and 4. FIG. 4 is a partial enlargement of FIG. 3. In FIGS. 3 and 4, the "alloy 1 of this invention" and the "alloy 2 of this invention" are corresponded with Sample Nos. 12 and 13 in Example, respectively. As shown in FIG. 3, when measuring at diffraction angle of 2θ=30 to 80° by 40 kV and 40 mA using Kα1 ray of Cu vessel, conventional cemented carbide has peaks of tungsten-carbide phase, peaks of binder phase which contains at least one iron-group metals as a principal component, and peaks of solid solution phase consisting of at least one selected from carbide, nitride, and carbonitride of metals of the group 4a, 5a and 6a in the periodic-table.

In addition to these peaks, according to this invention, as shown in FIG. 4, peaks of solid solution phase which contains Zr and Nb at least appear. That is, at an X-ray diffraction peak, a cemented carbide of this invention has a 1st peak resulting from the solid solution phase which consists of at least one selected from the carbides, nitrides and carbonitrides of metals of the group 4a, 5a and 6a in the periodic-table which has peak top in 2θ=40.00 to 41.99°, and a 2nd peak resulting from the solid solution phase which has peak top in 2θ=38.00 to 39.99° and which contains Zr and Nb at least. It is the big feature of this invention to have those two peaks. Accordingly, strength and hardness in high temperature of cemented carbide are increased. Since the cutting tool obtained by using this cemented carbide is excellent in wear resistance, plastic deformation resistance, and fracture resistance in cutting of hardly machinable material, such as stainless steel, and enables high efficiency cutting.

In order to remove the error by factors other than the above-mentioned measurement conditions, it is necessary to correct a peak indicating WC (100) face in each measurement data into 2θ=35.62° shown in JCPDD-ICDD (Japanese Committee on Powder Diffraction Data-International Center for Diffraction Data).

When the solid solution phase containing Zr and Nb does not precipitate (i.e., when a peak intensity ratio is less than 0.1), strength in high temperature and thermal conductivity of cemented carbide fall. If hardly machinable material, such as stainless steel, is out using such cemented carbide, a cutting temperature will rise remarkably. Consequently, hardness of cemented carbide fall, and wear resistance and plastic deformation resistance of a tool fall. On the other hand, when the solid solution phase containing Zr and Nb deposits superfluously (i.e., a peak intensity ration exceeds 2), alloy hardness runs short. Therefore, it is desirable in this invention that a ratio (p2/p1) of strength (p1) of the 1st peak and strength (p2) of the 2nd peak is 0.1 to 2.

As a solid solution phase, It is desirable that in addition to solid solution at Zr and Nb, at least one other solid solution phases which consist of at least one selected from metals (Ti, V, Cr, Mo, Ta, and W) other than Zr or Nb, in metals of the group 4a, 5a and 6a in the periodic-table, especially which consist of carbides, nitride and carbonitride of Ti as a main component, thereby maintaining high temperature characteristics, especially oxidation resistance in high temperature of cemented carbide.

In order to acquire a solid solution phase of Zr and Nb which have more excellent characteristics, it is desirable that a content ratio (Zr/Zr+Nb) of Zr and Nb is 0.5 to 0.7. If the content ratio (Zr/Zr+Nb) of the Zr and Nb is smaller than 0.5, other carbide, such as TiC, will form a solid solution, without forming solid solution phase of Zr and Nb, and high temperature strength and plastic deformation resistance of cemented carbide will fall. On the other hand, if the content ratio (Zr/Zr+Nb) of Zr and Nb exceeds 0.7, solid solution of Zr and Nb will cause superfluous precipitation and grain growth, and alloy strength and hardness will fall.

When there is a surface region of (p2)>0 and (p1)=0 from the surface of cemented carbide toward the inside of cemented carbide, the toughness at the time of cutting is raised further, and the excellent fracture resistance is obtained. This shows that the solid solution phase which contains Zr and Nb at least exists in a surface region. This solid solution phase improves alloy strength in high temperature. Moreover, since other solid solution phases, such as TiC, disappear and the amount of binder phases is increased relatively, the cemented carbide is toughened. The thickness of this surface region is about 100 $\mu$m from the surface of the cemented carbide. When the thickness of the surface region of (p2)>0 and (p1)–0 exceeds 100 $\mu$m, wear resistance may fall and the amount of tool wears may increase remarkably.

Here, the solid solution phase containing Zr and Nb contains Zr and Nb as a principal component, and especially consists of carbide, nitride, or carbonitride of metals wherein the total amount of Zr and Nb is 70% by weight or more to the total amount of metals in the solid solution phase. Furthermore, in order to maintain fracture resistance, thermal shock resistance, welding resistance with workpiece, and wear resistance with sufficient balance and to raise the machinability as a tool, it is desirable that a mole ratio expressed with Zr/(Zr+Nb) in the solid solution phase containing Zr and Nb is 0.5 to 0.7.

Moreover, in order to raise adhesion with a hinder phase and to raise strength and hardness in high temperature, the solid solution phase containing Zr and Nb may contain at least one selected from metals (Ti, V, Cr, Mo, Ta, W), among metals of the groups 4a, 5a and 6a in the periodic-table other than Zr or Nb, especially W and/or Ti at the ratio of 30 volume % or less of the total amount. A content ratio of each metal component in the solid solution phase in this invention can be measured by the energy dispersive X-ray analysis (EDS).

It is desirable that a content of the solid solution phase which contains Zr and Nb is 1 to 10 volume % to whole quantity of the cemented carbide, in order to satisfy both of alloy strength and hardness in high temperature.

It is desirable that a total content of solid solution phases other than the solid solution phase containing Zr and Nb is 1 to 10 volume % to the whole quantity or cemented carbide, in order to satisfy both of oxidation resistance in high temperature, and strength and hardness.

Furthermore, according to this invention, when a Ta content among metals of the group 4a, 5a, and 6a in the periodic-table in the whole quantity of the cemented carbide is 0.8% by weight or less, especially 0.5% by weight or less by TaC conversion, more preferably when not containing Ta except for an unescapable impurity, excellent wear resistance, plastic deformation resistance and excellent fracture resistance can be maintained. That is, a cemented carbide excellent in thermal and mechanical properties, i.e., 1400 or more of Vickers hardness (Hv), 12 MPa/m$^{1/2}$ or more of fracture toughness ($K_{1c}$), 2500 MPa or more of three points bending strength, and 600 or more of hot hardness in 800° C., can be obtained, without using very expensive Ta raw material as compared with other raw materials.

According to this invention, in order to maintain high hardness, high strength, high toughness, and characteristics in high temperature, it is desirable that a content ratio of tungsten-carbide phase in the whole quantity of the cemented carbide is 60 to 95 volume %, and especially 80 to 90 volume % by WC conversion.

On the other hand, in order to retain alloy strength and fracture resistance, especially the binder phase that exists between tungsten-carbide phases contains iron-group metals, such as Co, Ni, and Fe, at a rate of 80% by weight or more. A content ratio of a binder phase may be 1 to 20 volume %, especially 10 to 15 volume % of the entire cemented carbide.

Since cemented carbide as mentioned above has mechanical and thermal characteristics excellent in hardness, strength and thermal conductivity, it can be applied to a mold, an abrasion-proof member, a high temperature structural material, etc., and can be suitably used especially as a cutting tool, especially a cutting tool for hardly machinable material, such as stainless steel.

It is desirable that a cutting tool is composed of the above cemented carbide; and a single layer or two or more layers formed on the surface of the cemented carbide, and consisting of at least one coatings selected from the group consisting of metal carbide, metal nitride, metal carbonitride, TiAlN, TiZrN, TiCrN, diamond, and $Al_2O_3$. Here, the above-mentioned metal is at least one selected from the groups 4a, 5a and 6a in the periodic table.

(Manufacture Method)

In order to manufacture the cemented carbide mentioned above, for example, 80 to 90% by weight of tungsten-carbide powder of 0.5–10 $\mu$m of mean particle diameters, 0.1–10% by weight of at least one powder of carbide, nitride and carbonitride of Zr and Nb or powder of its solid solution of 0.5 10 $\mu$m of mean particle diameters in a total amount; 0.1 to 10% by weight of at least one of carbide, nitride and carbonitride powders of metals (Ti, V, Cr, Mo, Ta, and W) of the group 4a, 5a, and 6a in the periodic table other than Zr and Nb or these solid solution powders in a total amount; and 5 to 15% by weight of iron-group metals of 0.5 to 10 $\mu$m of mean particle diameters, and further metal tungsten (W) powder or carbon black (C) may be mixed, if necessary.

Next, the above-mentioned mixed powder is molded in predetermined form by the well-known methods, such as a press forming, casting, extrusion, and cold isostatic press molding. After temperature-up is carried out at 1 to 20° C./min. in vacuum of 0.1 to 15 Pa vacuum, the resulting green body is sintered at 1350–1500° C. for 0.2 to 5 hours, especially 0.5 to 2 hours. The cemented carbide mentioned above by this can be obtained.

Since the cemented carbide of this invention has mechanical properties and thermal characteristics excellent in hardness, strength, and toughness, it can be applied to a mold, an abrasion-proof member, a high temperature structural material, etc., and can be preferably applied to a cutting tool, and especially a cutting tool suitable for cutting of hardly machinable material, such as stainless steel, and for high efficiency cutting under high-spaced and high feeding.

The coating can be formed on cemented carbide using the same method as the above mentioned. Thickness of the coating is 0.1 to 30 μm, preferably 0.1 to 20 μm.

(3rd Cemented Carbide)

This cemented carbide is composed of WC phase, 2 to 20% by weight, preferably 6 to 15% by weight of binder metals which consist of at least one of cobalt (Co) and nickel (Ni), 0 to 30% by weight, preferably 2 20% by weight, more preferably 5–15% by weight of crystal phases which consist of at least one selected from carbides, nitride and carbonitride of metals of the group 4a, 5a, and 6a in the periodic-table, and unescapable impurities.

Here, if the total content or binder metals which consist of at least one of Co and nickel is lower than 2% by weight, the amount of liquid phases generated at the time of sintering will be insufficient, and sintering will become poor. Consequently strength of cemented carbide will fall. On the contrary, if the total content of binder metals exceeds 30% by weight, the amount of binder metals in cemented carbide becomes superfluous. Consequently hardness will falls, and in case that it is used for metalworking as a cutting tool, plastic deformation will be carried out greatly.

According to this invention, in order to raise the hardness of cemented carbide and to control each metal concentration of iron (Fe), chromium (Cr), cobalt (Co), and nickel (nickel) within the predetermined range, it is desirable that at least one selected from carbides, nitrides and carbonitrides of metal of the groups 4a, 5a and 6a in the periodic-table is contained at a rate of 30% by weight or less.

In cemented carbide, a Fe content is controlled to 10 to 300 ppm, and Cr content is controlled to 100 to 1000 ppm. The inside of cemented carbide possesses a surface region which is satisfied of the condition of $p_{suf}<p_{in}$, in $p_{in}=w_{2in}/w_{1in}$ and $p_{suf}=w_{2suf}/w_{1suf}$ as described above. That is, the large feature of this invention is to make the content ratio of Fe and Cr to binder metals in the surface of cemented carbide smaller than it inside cemented carbide. Thus, welding and adhesion with workpiece can be inhibited, and when a hard coat is coated, a good hard coat can be formed.

Here, the Fe content in cemented carbide cannot be industrially made lower than 10 ppm. On the other hand, if the Fe content in cemented carbide exceeds 300 ppm, welding and adhesion with workpiece will become remarkable, and machinability will fall. If the Cr content is lower than 100 ppm, grain growth of tungsten-carbide phase will become remarkable, and strength and toughness of cemented carbide will fall. On the contrary, if the Cr content exceeds 1000 ppm, welding and adhesion with workpiece will become remarkable, and machinability will fall.

The contents of Fe and Cr in cemented carbide can be measured by ICP emission spectrochemical analysis. That is, the solution which dissolved, by the well-known method, powders obtained by grinding a sintered cemented carbide with a mortar made from cemented carbide etc. is produced, and, subsequently the contents of Fe and Cr in the solution are measured by ICP emission spectrochemical analysis. In order to measure the ratio of the local content of Iron (Fe), chromium (Cr), cobalt (Co), and nickel (nickel) in the surface and the inside, a laser ICP mass analysis can be used. In this invention, the "inside of cemented carbide" means a region deep 1 mm or more from the surface of cemented carbide.

It is desirable that the maximum of the ratio ($p_{suf}/p_{in}$) of $p_{sur}$ and $p_{in}$ an in the surface region is 0.5 to 0.95, especially 0.6 to 0.8, in order to improve welding resistance and adhesion resistance on the surface of cemented carbide.

It is desirable that the thickness of a surface region is 1 to 20 μm, in order to inhibit welding and adhesions of workpiece etc., to maintain hardness of the surface region, and to prevent plastic deformation.

It is desirable that Wc phase in cemented carbide is a hexagonal system, and its mean particle diameter is 0.5 to 3.0 μm. Here, the mean particle diameter of crystal phases, such as WC phase in this invention, is measured by an intercepting method using the SEM photograph of cemented carbide cross-section.

According to this invention, at least one layer of a hard coat which consists of at least one selected from metal carbide, metal nitride, metal carbonitride, TiAlN, TiZrN, TiCrN, DLC (diamond-like carbon), diamond, and $Al_2O_3$ may be coated on the surface of cemented carbide. Thus, hardness and wear resistance of the surface of cemented carbide can be raised remarkably. Here, the above-mentioned metal is at least one selected from metals of the group 4a, 5a and 6a in the periodic-table.

In case that a hard coat layer is formed on the surface of cemented carbide, since the content ratio of Fe and Cr in the cemented carbide surface is low, reduction of a carbon content by formation of ferrite, a chromium carbide, etc. does not occur. Accordingly, a good hard coat layer can be formed, without formation of embrittlement layers, such as η phases (W3Co3C, W6Co6C, etc.) which are lower carbide of cobalt, generating near an interface between cemented carbide body and hard coat layer.

It is desirable that the thickness of the hard coat layer is 1 to 30 μm on the whole, thereby maintaining both or wear resistance and toughness. The hard coat layer can be formed by the well-known thin film forming method, such as PVD and CVD.

(Manufacture Method)

Next, a manufacture method of cemented carbide mentioned above is explained. First, the following materials are weighed and mixed.

(1) 70–90% By weight of WC powder whose mean particle diameter is 0.5 to 10 μm, and the contents of Fe and Cr are 0.005 to 0.1% by weight, respectively;

(2) 0.1 to 30% by weight of powder of carbides, nitrides and/or carbonitrides of metals selected from the groups 4a, 5a and 6a in the periodic-table, or solid solution powder, thereof whose mean particle diameter is 0.5 to 10 μm, and the contents of Fe and Cr are 15 to 500 ppm, respectively;

(3) 5–15% by weight of cobalt (Co) and/or nickel (Ni), each mean particle diameter of which is 0.5 to 10 μm, and that iron (Fe) content is 1 to 15 ppm, and chromium (Cr) content is 1 to 20 ppm; and (4) if request, a certain amount of metal tungsten (W) powder or carbon black (C).

The mixed powder is put in a grinder, and the dispersion medium, such as alcohol, acetone or hydrocarbon, is added and wet grinding is carried out for 5 to 30 hours. As for a grinder, it is desirable to have lining and media, stirring arms, etc, composed of materials which do not contain iron (Fe) and chromium (Cr), for example, cemented carbide of 99.9% or more of purity. After grinding, granulation to the desired grain size is performed by the well-known granulation methods, such as spray drying. Here, if grinding time is shorter than 5 hours, raw material powders cannot fully be ground and mixed, and a desired uniform surface region cannot be formed. On the contrary, if grinding time is longer than 30 hours, a large amounts of tungsten carbide component and other impurities are mixed to the powder from the grinder, whereby a composition gap of mixed powder is caused.

Next, the obtained mixed powder is molded in a predetermined form by the well-known molding methods, such as a press forming, casting, extrusion, and cold isostatic press molding. The temperature-up of the green body to the 1st sintering temperature of 1350–1600° C. is carried out at a velocity of 1 to 20° C./min. under a non-oxidizing atmosphere of 20 Pa or more, and subsequently it retains especially at the 1st sintering temperature for 0.3 to 2 hour, especially for 0.5 to 1 hours. The "non-oxidizing atmosphere" means the enclosure state or flow state of inert gas, e.g. nitrogen gas ($N_2$), helium gas (He), argon gas (Ar), xenon gas (Xe), etc.

In this non-oxidizing atmosphere, some of binder metals which consist of cobalt (Co) and/or nickel (nickel) serve as a metal liquid phase by carrying out short-time retention with the 1st sintering temperature. At this time, iron (Fe) and chromium (Cr) are fused and diffused together with cobalt (Co) and nickel (nickel).

Next, the temperature is lowered from the 1st sintering temperature to the 2nd sintering temperature low 20 to 200° C. as compared with from the 1st sintering temperature, preferably and the temperature is lowered at 5–50° C./hour of temperature-fall velocity, in order to optimize the distribution state of each metal in cemented carbide. Further, it retains at especially 1200–1380° C. of the 2nd sintering temperature in the vacuum lower than 10 Pa for 1 to 3 hours. As a result, Co (cobalt) and/or nickel (Ni) evaporate in vacuum atmosphere selectively from the surface. On the other hand, Co (cobalt) and/or nickel (Ni) which exist in an inside are selectively spread to the surface. Consequently, the concentration gradient of the predetermined metals can be formed in a sintered body. Then, the cemented carbide of this invention is producible by cooling to a room temperature.

Here, if the 1st sintering temperature is lower than 1350° C., since temperature is low, a proper quantity of liquid phase cannot be made to generate, whereby densification of the sintered body cannot fully be carried out. Conversely, if the 1st sintering temperature is higher than 1600° C., sintering will advance too much, hard grains, such as a tungsten-carbide grain, will carry out grain growth, whereby toughness and strength will fall. Moreover, a large amount of cobalt (Co) and/or nickel (Ni) in a metal liquid phase evaporate from the surface selectively, and for this reason, a concentration distribution of metals in the surface cannot be made into the predetermined range, whereby embrittlement of the surface is carried out.

If the retention time in the 1st sintering temperature is shorter then 0.1 hours, a proper quantity of the liquid phase cannot be generated, whereby the densification of the sintered body cannot fully be carried out. Conversely, if the retention time in the 1st sintering temperature is longer than 2 hours, sintering will progress superfluously and toughness and strength will fall. Furthermore, iron (Fe) and chromium (Cr) are precipitated on the surface by exceeding the predetermined quantity, or embrittlement of the surface is carried out.

If the difference of the 2nd sintering temperature and the 1st sintering temperature is smaller than 20° C., a difference will not arise in the migration speed (diffusion rate) of cobalt (Co) and nickel (Ni) to iron (Fe) and chromium (Cr). Hence, it becomes impossible to form a desired concentration distribution in cemented carbide. On the contrary, if the difference of the 2nd sintering temperature and the 1st sintering temperature is larger than 200° C., the diffusion rate of each metal will fall on the whole, whereby it becomes impossible to form a predetermined metal concentration gradient.

(4th Cemented Carbide)

Figure 5:
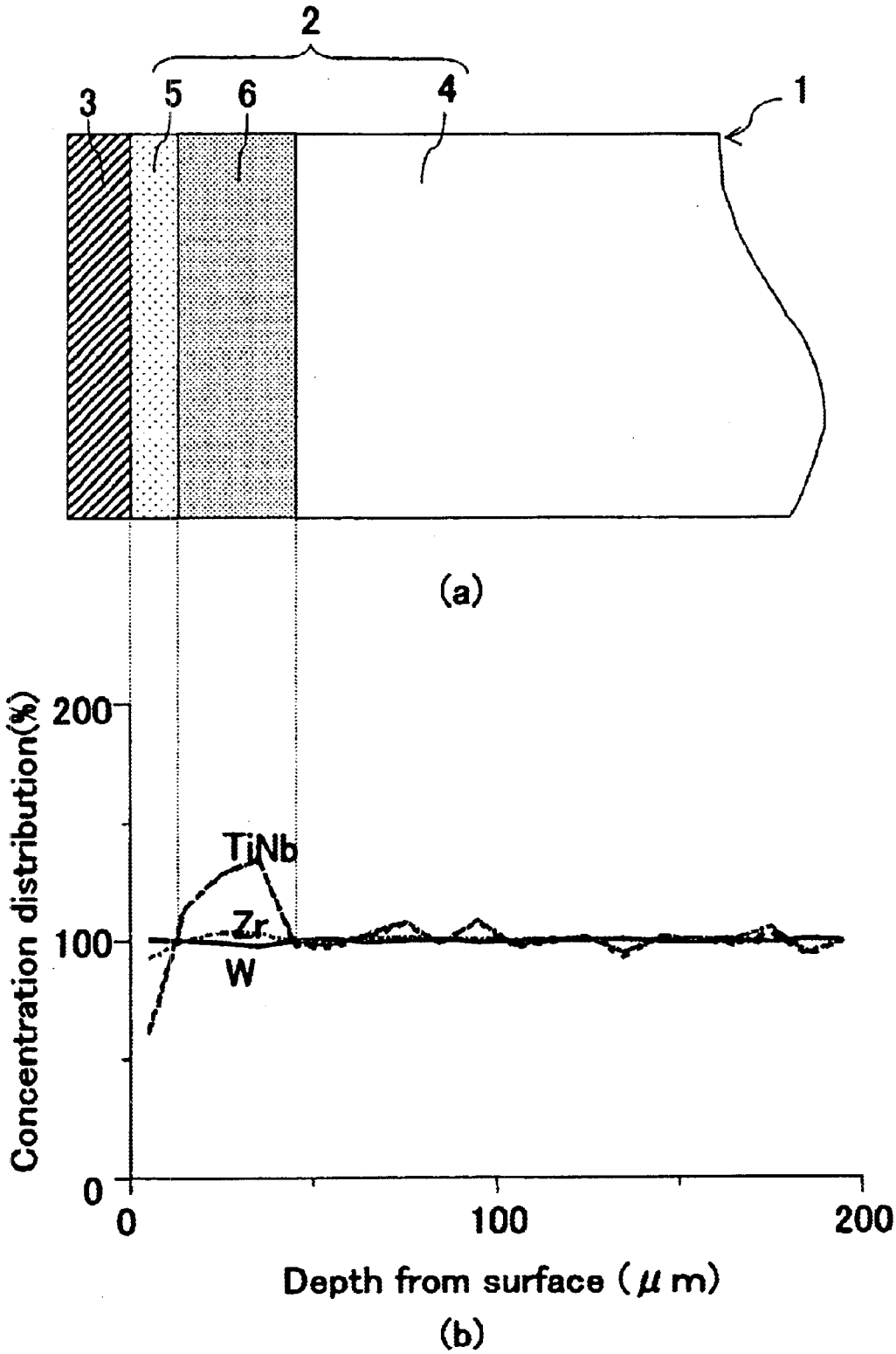
FIGS. 5(*a*) and (*b*) are schematic sectional views showing an example of the 4th surface coated cemented carbide of this invention, and a graph in which the concentration distribution of each metallic element in cemented carbide, respectively.

FIG. 5(*a*) shows a schematic sectional view of a surface coated cemented carbide 1. As shown in FIG. 5(*a*), the hard coating 3 is formed on the surface of a cemented carbide 2. The cemented carbide 2 consists of WC (tungsten carbide), and one or more of carbide, nitride and carbonitride of at least one metallic element M which selects from metals (Ti, V, Cr, Zr, Nb, Mo, Hf, Ta, and W) of the groups 4a, 5a and 6a in the periodic-table, and a binder material comprising iron-group metal (Co, Ni or Fe). At this time, it is the large feature of this invention to contain both Zr and Nb as the above-mentioned metallic element M, whereby the surface region which has the predetermined depth shown below can be formed. As a metallic element M, at least one sort which selects from Ti, V, Cr, Mo, Hf, and Ta, other than Zr and Nb, is mentioned.

According to this invention, a 1st surface region 5 which fulfills the conditions expressed with the following formula, and a 2nd surface region 6 located inside this 1st surface region 5 are provided in the depth region of 5 to 50 $\mu$m from the surface of the cemented carbide 2.

$$0.1 \leqq q_{1suf}/q_{in} \leqq 0.9,$$

$$0.9 \leqq r_{1suf}/r_{in} \leqq 1.1,$$

$$1.1 \leqq q2_{suf}/q_{in} \leqq 1.5, \text{ and}$$

$$0.9 \leqq r_{2sur}/r_{in} \leqq 1.1$$

wherein $q_{in}$, $q_{1suf}$, $r_{2suf}$, $r_{in}$, $r_{1suf}$, and $r_{2suf}$ are defied as described above.

Thus, toughness in the surface of the cemented carbide 2 can be raised, and fracture resistance of the hard coating 3 can be raised. Moreover, oxidation resistance of the surface coated cemented carbide 1 in which a hard coating 3 was formed can be raised. Accordingly, the surface coated cemented carbide 1 exhibits excellent fracture resistance and wear resistance, even when operating under high temperature environment, like cutting of hardly machinable material, such as not only steel and cast iron, e.g., carbon steel and an alloy steel, but stainless steel etc. Therefore, this surface coated cemented carbide 1 is suitable for the use of cutting in particular.

Here, if $q_{1suf}/q_{in}$ in the 1st surface region 5 is smaller than 0.1, oxidation resistance in the surface of cemented carbide 2 will fall. Especially, when using continuously in a high temperature region, the surface of cemented carbide 2 is deteriorated, whereby the hard coveried layer 3 is exfoliated, or plastic deformation is caused. On the contrary, if $q_{1suf}/q_{in}$ is larger than 0.9, toughness of the surface of cemented carbide 2 will fall, shock resistance of the hard coating 3 will fall, and therefore it will become easy to generate chipping.

If $r_{1suf}/r_{in}$ is smaller than 0.9, oxidation resistance in the surface of cemented carbide 2 will fall. Especially, when using continuously in a high temperature region, the surface of cemented carbide 2 is deteriorated, whereby the hard coating 3 is exfoliated or it becomes easy to generate chipping. Furthermore, plastic deformation resistance in the cutting edge gets worse, and the fall of abrasion resistance may be caused. If $r_{1suf}/r_{in}$ is larger than 1.1, plastic deformation resistance and wear resistance on the surface of cemented carbide will fall.

Moreover, if $q_{2suf}/q_{in}$ is smaller than 1.1 in the 2nd surface region 6, the remarkable hardness fall portions will be formed in the 2nd surface region 6, and wear resistance and plastic deformation resistance will fall. On the contrary, if $q_{2suf}/q_{in}$ is larger than 1.5, the remarkable toughness-fall portions will be formed in the 2nd surface region 6, and fracture resistance will fall. If $r_{2suf}/r_{in}$ is smaller then 0.9, the remarkable hardness-fall portions will be formed in the 2nd surface region 6, and wear resistance and plastic deformation resistance will fall. On the contrary, if $r_{2suf}/r_{in}$ is larger than 1.1, the remarkable fall portion of a toughness value will be formed in the 2nd surface region 6, and fracture resistance will fall.

The distribution state of the metallic element M in this invention can be determined by measuring tho component ratio in each position inside the cemented carbide with the energy dispersive X-ray analysis (EDS), followed by mapping as shown in FIG. 5(*b*).

The total thickness of the 1st surface region 5 and the 2nd surface region 6 in this invention is suitably 5 to 200 μm, particularly 5 to 50 μm. If the total thickness of the 1st surface region 5 and the 2nd surface region 6 is thinner than 5 μm, the effect of the improvement in toughness will be small, and if exceeding 200 μm, surface hardness and plastic deformation resistance will fall.

It is desirable that the thickness d1 of the 1st surface region is 1 to 50 μm, particularly 1 to 10 μm, in order to satisfy both of oxidation resistance and fracture resistance.

It is desirable that the thickness d2 of the 2nd surface region 6 is 10 to 200 μm, particularly 10 to 40 μm, in order to satisfy wear resistance, plastic deformation resistance, and fracture resistance. Furthermore, it is desirable that the ratio of d1/d2 is 0.1 to 0.6 in order to satisfy oxidation resistance and fracture resistance.

In order to raise fracture resistance, wear resistance, and oxidation resistance, it is desirable that the cemented carbide 2 contains Nb with Zr at the predetermined ratios as shown below.

$0.1 \leqq Zr/(Ti+Zr+Hf) \leqq 0.5$, particularly $0.1 \leqq Zr/(Ti+Zr+Hf) \leqq 0.4$ $0.6 \leqq Nb/(V+Nb+Ta) \leqq 1.0$, particularly $0.7 \leqq Nb/(V+Nb+Ta) \leqq 1.0$ Furthermore, it is desirable to satisfy $0.05 \leqq Zr/(Zr+Nb) \leqq 0.8$, particularly $0.1 \leqq Zr/(Zr+Nb) \leqq 0.6$ in the entire cemented carbide.

In order to satisfy oxidation resistance, wear resistance, plastic deformation resistance, and fracture resistance, the desirable concrete composition of cemented carbide 2 is composed of 0.1–1.5% by weight of ZrC (zirconium carbide), 0.5–3.5% by weight of NbC (carbonization niobium), 1–2.5% by weight of TiC (titanium carbide), 0–1% by weight of TaC (tantalum carbide), 0–1% by weight of HfC (hafnium carbide), 0 1% by weight of $Cr_3C_2$ (chromium carbide), 0–1% by weight of VC (vanadium carbide), 6–10% by weight of Co (cobalt). The rest consists of WC (tungsten carbide) and unescapable impurities.

For reduction of cost, it is more desirable that the content of expensive TaC is 0.5% by weight or less, especially 0.1% by weight or less in the above-mentioned components. It is more desirable not to contain TaC substantially.

When using as a cutting tool for turning, the following composition ranges considering wear resistance as important property are desirable. Composition ranges: 1.5–2.0% by weight of TiC, 2.0–3.5% by weight of NbC, 0.1–0.8% by weight of ZrC, 5.0–7.5% by weight of Co, and the rest consisting of WC.

When using as a cutting tool for milling, the following composition ranges considering fracture resistance as important property are desirable.

1.5–2.0% by weight of TiC(s), 0.5–2.0% by weight of Nb(s), 0.8–1.5% by weight of ZrC(s), 7.5–10.0% by weight of Co(es) (it consists of WC), the rest.

Moreover, according to this invention, in order to operate stably in a high temperature region, like cutting a hardly machinable material, such as stainless steel, etc., it is important that oxidation resistance of surface coated cemented carbide 1 is 0.01 mg/mm$^2$ or less. That is, if oxidation resistance of surface coated cemented carbide 1 is larger than 0.01 mg/mm$^2$, the surface of cemented carbide 2 will be oxidized through defects which exist in the hard coating at the time of processing, thereby resulting in fall of wear resistance and fracture resistance.

Oxidation resistance in this invention means the increase rate of the amount of oxidation before and behind the examination at the time of performing the oxidation test which retains the surface coated cemented carbide in which the hard coating was formed, on the conditions for 800° C. for 30 minutes in the atmosphere.

A hard coating formed in the surface of cemented carbide 2 is composed of at least one a single layer or two or more layers selected from metal carbide, metal nitride, metal oxide, metal carbonitride, metal carbonation thing, metal nitride-oxide, metal carbonated-nitride, and diamond. Preferably, the hard coating is composed of at least one a single layer or two or more layers selected from TiCr, TiN, TiCN, $Al_2O_3$ and TiAlN. In FIG. 5(*a*), the hard coating 3 consists of TiC layer, Al2O3 layer, and TiN layer sequentially from the cemented carbide 2 side.

(Manufacture Method)

In order to manufacture the surface coated cemented carbide cemented, for example, 90 to 90% by weight of tungsten-carbide powder of 0.5 to 10 μm of mean particle diameters; 0.1 to 10% by weight of at least one powder of carbide, nitride and carbonitride of Zr or powder of its solid solution of 0.5 to 10 μm of mean particle diameters in a total amount; 0.1 to 10% by weight of at least one powder of carbide, nitride and carbonitride of Nb or powder of its solid solution having 0.5 to 5 μm of mean particle diameters in a total amount; 0.1 to 10% by weight of at least one of carbide, nitride and carbonitride powder of metals selected from Ti, V, Cr, Mo, Hf and Ta or solid solution powders of two or more of these metals having 0.5 to 5 μm of mean particle diameters in a total amount in a total amount; and 5 to 15% by weight of iron-group metals of 0.5 to 10 μm of mean particle diameters, and further metal tungsten (W) powder or carbon black (C) may be mixed by request.

Next, the above-mentioned mixed powder is molded in a predetermined form by the well-known molding methods, such as a press forming, casting, extrusion, and cold isostatic press molding. After temperature-up is carried out at 0.3 to 4° C./min., particularly 0.5 to 2° C./min. in 1000° C. or more at 0.1 to 15 Pa vacuum, the resulting green body is sintered at 1350 to 1500° C. for 0.2 to 5 hours, particularly 0.5 to 2 hours. Thus, the cemented carbide mentioned above is obtained.

In order to control composition and thickness of a surface region, it is important to control temperature-up velocity and the atmosphere in sintering within the above-mentioned range.

Next, a hard coating which was described above by the well-known thin film forming methods, such as CVD and PVD, is formed on the surface of the cemented carbide by the thickness of 0.1 to 30 μm, preferably 0.1 to 20 μm. Thus, the surface coated cemented carbide of this invention is obtained.

Since the surface coated cemented carbide of this invention has a mechanical properties and thermal characteristics excellent in hardness, toughness and strength and having high oxidation resistance, it can be adapted for a mold, an abrasion-proof member, a high temperature structural material, etc., and can be suitably used as a cutting tool for processing steel, cast iron (e.g., carbon steel, alloy steel, etc.), especially as a cutting tool for hardly machinable material, such as stainless.

That is, the cemented carbide of this invention can be used for the tool for cutting processes in turning, face mill used in a milling machine or a machining center, an end mill, a ball end mill, a tool material kind for drills, etc. general-purpose.

EXAMPLE

Example I

1st Cemented Carbide

Tungsten-carbide (WC) powder of 8.0 μm of mean particle diameters shown in Table 1, the metal cobalt (Co) powder of 1.2 μm of mean particle diameters and the compound powder of 2.0 μm of mean particle diameters shown in Table 1 were added and mixed by the ratio shown in Table 1.

After molding the mixture in cutting tool shape (SDK42, CNMG43) by the press forming, cemented carbide was produced by raising a temperature at the velocity of 10° C./min. from a temperature lower 500° C. or more than a sintering temperature, followed by sintering at 1500° C. for 1 hour.

In the cut side in the direction of oblique section including the arbitrary surface, hardness was measured toward the inside in the portion which is equivalent to each depth from the surface.

5a, and 6a in the periodic-table is higher than the inside of cemented carbide was determined.

Moreover, about B1 type solid solution phase with high contents of Zr, deposition of D1 type solid solution (gray) which can confirm the sample which carried out mirror-plane processing of the grinding side in the arbitrary region (20 μm×20 μm) in SEM electron microscope (reflection-electron image) observation, and deposition of the solid solution from which color differs can be distinguished. Therefore, mean particle diameter of D1 type solid solution phase with high contents of Zr distinguished by SEM electron microscope observation was measured by the Luzex image-analysis method. These results are shown in Table 1.

The "minimum hardness ratio (%)" in Table 1 shows the ratio of the minimum hardness of the surface region of cemented carbide and internal hardness, i.e., "minimum hardness of surface region/hardness of inside".

The "Zr/βincrease region" in Table 1 means the region where the ratio of Zr in metals of the groups 4a, 5a, and 6a in the periodic-table is higher than an inside, and mark "O" shows that the region exists, and mark "x" shows that the region does not exist.

The "thickness (μm)" in "Zr/β increase region" is thickness of the region where the ratio of Zr in metals of the groups 4a, 5a, and 6a in the periodic-table is higher than an inside.

Furthermore, the "β phase containing Zr" in Table 1 means B1 type solid solution phase with high contents of Zr, and mark "O" shows that the region exists, and mark "x" shows that the region dock not exist. The "particle diameter (μm)" in "β phase containing Zr" means particle diameter of B1 type solid solution phase with high contents of Zr.

TABLE 1

| Sample | Composition (wt %) | | | | | | | Minimum hardness ratio (%) | Zr/β increase region | | Zr containing β phase | |
|---|---|---|---|---|---|---|---|---|---|---|---|---|
| | | | | | | | | Minimum hardness of surface | | Thickness | | Particle |
| No. | WC | Co | TiC | TiN | TaC | NbC | ZrC | region/hardness of inside(Hv) | | (μm) | | diameter (μm) |
| 1 | 87.0 | 8.0 | 2.0 | 0.0 | 0.0 | 1.0 | 2.0 | 95.0 | ○ | 52.0 | ○ | 1.2 |
| 2 | 88.0 | 8.0 | 0.0 | 0.0 | 2.0 | 1.0 | 1.0 | 95.0 | X | — | ○ | 2.1 |
| 3 | 77.0 | 10.0 | 3.0 | 0.0 | 4.0 | 3.0 | 3.0 | 90.0 | ○ | 144.0 | ○ | 4.4 |
| 4 | 89.0 | 6.0 | 2.0 | 0.0 | 0.5 | 0.5 | 2.0 | 98.0 | ○ | 2.8 | X | — |
| 5 | 90.0 | 6.0 | 0.5 | 0.0 | 2.0 | 0.5 | 1.0 | 97.0 | ○ | 10.0 | X | — |
| 6 | 85.0 | 6.0 | 2.5 | 0.0 | 2.0 | 2.5 | 2.0 | 96.0 | ○ | 32.0 | ○ | 0.8 |
| 7 | 83.0 | 8.0 | 3.5 | 0.0 | 0.0 | 2.5 | 3.0 | 92.0 | ○ | 74.0 | ○ | 3.0 |
| *8 | 86.0 | 8.0 | 2.0 | 2.0 | 2.0 | 0.0 | 0.0 | 70.0 | X | — | X | — |
| *9 | 87.0 | 6.0 | 2.0 | 1.5 | 0.0 | 1.5 | 2.0 | 75.0 | ○ | 33.0 | ○ | 2.6 |
| *10 | 87.0 | 8.0 | 1.0 | 1.5 | 0.5 | 1.0 | 1.0 | 88.0 | X | — | ○ | 1.7 |
| *11 | 88.0 | 6.0 | 2.0 | 0.0 | 3.0 | 0.0 | 1.0 | 110.0 | X | — | X | — |

Sample numbers marked with * are not within the scope of the present invention.

The measurement was performed by using the micro Vickers equipment (MVK-G3) made from Akashi Corporation, on conditions of 200 q of loads and 10 seconds of retention time. The hardness in each depth is the average of the hardness of at least three points measured in the depth. On the other hand, hardness in a depth of at least 1000 μm was measured, and this is the hardness inside cemented carbide in this invention.

The content ratio of each metal component in the solid solution phase inside cemented carbide was determined by the energy dispersive X-ray analysis (EDS). Thus, the region where the ratio of Zr in metals selected from the groups 4a, The cutting tool was produced by forming the TiN film of 2 μm of thickness by PVD on the surface of each cemented carbide obtained. Using this cutting tool, cutting of stainless steel was performed for 15 minutes on the following conditions, and the flank abrasion loss and the amount of notch damages of a cutting tool were measured.

During the cutting examination, in case that a flank abrasion loss amounted to 0.2 mm or the amount of notch damages amounted to 0.5 mm, the cutting time was measured. Furthermore, as a toughness examination, milling processing of a fluting alloy steel was performed and feed rate when producing a fracture was measured. These results are shown in Table 2.

(1) Abrasion test
Work piece: stainless steel (SUS304)
Tool shape: CNMG432
Cutting rate: 120 m/min.
Feed rate: 0.3 mm/rev
Depth or cut: 2 mm
Other conditions: with water-soluble cutting liquid (2) Toughness examination
Work piece: fluting alloy-steel (SCM440H)
Tool shape: SDK42
Cutting rate: 80 m/min.
Feed rate: variable 0.2–0.8 mm/edge
Depth of cut: 2 mm
Other conditions: dry type cutting

TABLE 2

| | Continuous cutting test (turning) | | Intermittent cutting test (milling) |
|---|---|---|---|
| Sample No. | Flank wear (mm) | Notch damage | Feed rate produced until failure (mm/tooth) |
| 1 | 0.12 | 0.25 | 0.70 |
| 2 | 0.14 | 0.38 | 0.55 |
| 3 | 0.18 | 0.20 | 0.65 |
| 4 | 0.12 | 0.44 | 0.50 |
| 5 | 0.10 | 0.48 | 0.50 |
| 6 | 0.15 | 0.33 | 0.65 |
| 7 | 0.19 | 0.28 | 0.70 |
| *8 | ×(10 min) | — | 0.40 |
| *9 | 0.2 | 0.55 | 0.60 |
| *10 | 0.16 | 0.33 | 0.30 |
| *11 | — | ×(8 min) | 0.25 |

The following points become clear from the results of Table 1 and Table 2. Sample No. 8 and 9 with the low minimum hardness of the surface region to an inside had bad wear resistance. Sample No. 10 of 88% of hardness had a problem in fracture resistance. Sample No. 11 with 110% of the hardness of a surface region which was higher than an inside had a problem in notch damage and was inferior to fracture resistance.

On the other hand, about sample No. 1–7 according to this invention which the minimum hardness of the surface region to an inside was made into 90–98%, each is 0.2 mm or less in flank abrasion loss, and does not have a problem in notch damage, and was excellent in the wear resistance. Moreover, sample No. 1–7 had the excellent fracture resistance, since feed rate which produces a fracture in a toughness examination was also more than practically sufficient 0.5 mm/edge.

These results are effectively obtained by having the region where the ratio of Zr in the metals selected from the group 4a, 5a, and 6a in the periodic-table is higher than an inside, and by having B1 type solid solution phase with high contents of Zr.

Moreover, as shown in sample Nos. 1, 4 and 7, even when TaC used so far in order to raise the high temperature characteristics of cemented carbide was hardly added, the cemented carbide which was able to balance wear resistance and fracture resistance was able to be obtained.

Example II

2nd Cemented Carbide

Tungsten-carbide (WC) powder of a mean particle diameter shown in Table 3, the metal cobalt (Co) powder of 1.2 μm of mean particle diameters and the compound powder of 2.0 μm of mean particle diameters shown in Table 3 were added and mixed by the ratio shown in Table 3. After molding the mixture in cutting tool shape (SDK42) by the press forming, cemented carbide was produced by raising a temperature at the velocity of 10° C./min. from a temperature lower 500° C. or more than a sintering temperature, followed by sintering at 1500° C. for 1 hour.

About three arbitrary sections of the obtained cemented carbide, X-ray diffraction analysis was performed using Kα1 ray of Cu vessel at angle of diffraction 2θ=30–80°, measurement time 0.6 sec, voltage 40 kV, and current 40 mA, with the X-ray-diffraction-analysis equipment (RINT1100) made by Rigaku Denki company. Furthermore, in order to remove the mutual error of all data, the peak which WC (100) side in each measurement data shows was corrected at 2θ-35.62 degree shown in JCPDS.

From this result, the 1st peak strength (p1) which has the peak top in 2θ=40.00–41.99 degree, and the 2nd peak strength (p2) which has the peak top in 2θ-38.00–39.99 degree were measured.

Moreover, the existence of the surface region which is (p2)>0 and (p1)=0 was measured by performing the X-ray diffraction analysis of a surface region using the above-mentioned X-ray diffraction equipment from the sintering skin of cemented carbide in the similar manner.

The result is shown in Table 3.

TABLE 3

| Sample | Composition(wt %) | | | | | | | XRD peak | | | |
|---|---|---|---|---|---|---|---|---|---|---|---|
| No. | WC | Co | TiC | TaC | NbC | ZrC | Zr/Zr + Nb | 1st peak | 2nd peak | p2/p1 | Surface XRD(1) |
| 12 | 87.0 | 8.0 | 2.0 | 0.0 | 1.0 | 2.0 | 0.7 | ○ | ○ | 0.2 | ○ |
| 13 | 88.0 | 8.0 | 0.0 | 2.0 | 1.0 | 1.0 | 0.5 | ○ | ○ | 0.05 | ○ |
| 14 | 83.0 | 10.0 | 0.5 | 0.5 | 2.0 | 4.0 | 0.7 | ○ | ○ | 2.6 | ○ |
| 15 | 87.5 | 6.0 | 2.0 | 2.0 | 0.5 | 2.0 | 0.8 | ○ | ○ | 1.2 | X |
| 16 | 90.0 | 7.0 | 1.5 | 0.0 | 1.0 | 0.5 | 0.3 | ○ | ○ | 0.1 | ○ |
| 17 | 86.0 | 7.0 | 1.0 | 1.0 | 2.0 | 3.0 | 0.6 | ○ | ○ | 0.3 | ○ |
| 18 | 84.5 | 9.0 | 0.5 | 2.0 | 2.0 | 2.0 | 0.5 | ○ | ○ | 1.0 | X |
| *19 | 84.5 | 8.0 | 3.0 | 2.0 | 2.0 | 0.5 | 0.2 | ○ | X | — | X |
| *20 | 86.5 | 8.0 | 0.5 | 0.0 | 2.0 | 3.0 | 0.6 | X | ○ | — | X |
| *21 | 90.5 | 6.0 | 2.0 | 0.5 | 1.0 | 0.0 | — | ○ | X | — | X |
| *22 | 93.0 | 6.0 | 0.0 | 0.5 | 0.0 | 0.5 | — | X | X | — | X |

(1)○: p2 > 0 and p1 = 0
X: Other than p2 > 0 and p1 = 0
Sample numbers marked with * are not within the scope of the present invention.

Moreover, the cutting tool was produced by forming the TiN film of 2 μm of thickness by PVD on the surface of each obtained cemented carbide.

By performing the cutting process by turning of stainless steel for 15 minutes as an abrasion test according to the same conditions as example I using this cutting tool, the flank abrasion loss and the amount of notch damage of a cutting tool were measured. During the cutting examination, when a flank abrasion loss amounted to 0.2 mm or the amount of notch damage amounted to 0.5 mm, the cutting time was measured. Furthermore, as toughness examination (i.e., milling processing of a fluting alloy steel) was performed according to the same conditions as example I and feed rate when a fracture produces was measured. The result is shown in Table 4.

TABLE 4

| | Continuous cutting test (turning) | | Intermittent cutting test (milling) |
|---|---|---|---|
| Sample No. | Flank wear (mm) | Notch damage | Feed rate produced until failure (mm/tooth) |
| 12 | 0.12 | 0.25 | 0.70 |
| 13 | 0.14 | 0.38 | 0.55 |
| 14 | 0.20 | 0.20 | 0.65 |
| 15 | 0.15 | 0.44 | 0.60 |
| 16 | 0.13 | 0.46 | 0.50 |
| 17 | 0.15 | 0.36 | 0.60 |
| 18 | 0.19 | 0.27 | 0.70 |
| *19 | ×(12 min) | — | 0.35 |
| *20 | 0.22 | 0.33 | 0.60 |
| *21 | 0.16 | 0.52 | 0.30 |
| *22 | — | ×(6 min) | 0.25 |

As is apparent from the result of Tables 3 and 4, Sample Nos. 19 and 21 in which the 2nd peak does not appear had a problem in fracture resistance, and were bad also about notch damage and wear resistance.

Sample No. 20 in which the 1st peak does not appear had a problem in wear resistance.

Sample No. 22, which is close to the so-called K sort cemented carbide in which the 1st peak and the 2nd peak do not appear, is interior in fracture resistance, and became impossible using in only 6 minutes about notch damage, and especially does not bear use at all in processing of stainless steel etc. On the other hand, each sample Nos. 12–18 concerning this invention and having the 1st peak and the 2nd peak was 0.2 mm or less in flank abrasion loss, and showed the wear resistance which does not have a problem in notch damage. Moreover, sample Nos. 12–18 had the excellent fracture resistance that a practically sufficient feed rate which produces a fracture in a toughness examination was more than 0.5 mm/edge.

Among these, the samples whose ratio (p2/p1) of the strength (p1) of the 1st peak and the strength (p2) of the 2nd peak is 0.1–2 had the good balance of wear resistance and fracture resistance. Particularly, the samples having the region of the (p2)>0 and (p1)=0 in the surface of cemented carbide was excellent in fracture resistance. Like sample Nos. 12, 14, and 16, even when TaC which has so far been used in order to raise the high temperature characteristics of cemented carbide was not added, the good cemented carbide which kept balance between wear resistance and fracture resistance can be obtained.

Example III

3rd Cemented Carbide

Tungsten-carbide (WC) powder whose mean particle diameter is 9 μm containing Iron (Fe) and chromium (Cr) in the amount shown in Table 5, metal cobalt (Co) powder and compound powder were weighed at the ratio shown in Table 5, and these powders were introduced in a attriter mill which has an inner wall, a media, and a stirring arm which consist of cemented carbide of 99.99% or more of purity.

After carrying out wet grinding for 18 hours by adding 2-propanol and granulating by spray dry, it molded in cutting tool shape (SDK1203) by the press forming.

Next, the obtained green body was setted to the vacuum sintering furnace, predetermined-time retention was carried out with the 1st sintering temperature shown in Table 5 which carried out a temperature up at the velocity for 12° C./min., the temperature was lowered to the 2nd sintering temperature at the temperature fall velocity shown in Table 5, predetermined-time retention was carried out with this 2nd sintering temperature, and thereafter it cooled to the room temperature. The vacuum atmosphere in Table 5 means that the inside of a furnace was controlled to the state with a degree of vacuum of 8 Pa or less, and the atmosphere of the various gas in Table 5 (Ar, N2, helium) means that the inside of a furnace was controlled to the state of 25 Pa.

The content of iron (Fe) and chromium (Cr) was measured by performing the ICP emission spectral analysis of the solution in which the obtained powder, that the obtained cemented carbide was ground with the mortar made from cemented carbide, was dissolved. Each iron content of the surface of cemented carbide and the surface which carried out 1 mm or more grinding was measured by laser ICP-MS. The measuring point of laser ICP-MS was taken as the circle region with a diameter of 10 μm.

TABLE 5

| | Composition of materials (wt %) | | | | | | | | | Grinding | 1st sintering | | |
|---|---|---|---|---|---|---|---|---|---|---|---|---|---|
| Sample No. | WC | TiC | TaC | NbC | ZrC | Co | Ni | Fe ppm | Cr ppm | media & stirring arm | Atm. | Temp. (° C.) | Time |
| *23 | Rest | 3 | | | | 8 | | 3000 | 4500 | c.c. | Ar | 1550 | 1.2 h |
| *24 | Rest | 2 | 10 | 2 | | 7 | | 500 | 700 | s.s. | N2 | 1500 | 1.5 h |
| *25 | Rest | | | | | 9 | | 300 | 500 | c.c. | He | 1500 | 3 h |
| *26 | Rest | 3 | | 5 | 1 | 10 | | 200 | 450 | c.c. | Ar | 1475 | 1.5 h |
| *27 | Rest | 5 | | | | 6 | 4 | 160 | 380 | c.c. | Vacuum | 1500 | 1 h |
| 28 | Rest | 2 | | | | 8 | | 90 | 200 | c.c. | He | 1550 | 1.2 h |
| 29 | Rest | 3 | 7 | | | 10 | | 120 | 450 | c.c. | Ar | 1420 | 2.0 h |
| 30 | Rest | 2 | | 1 | 2 | 10 | | 100 | 400 | c.c. | Ar | 1450 | 1.0 h |
| 31 | Rest | 5 | | | | 6 | 4 | 70 | 300 | c.c. | N2 | 1525 | 1.2 h |
| 32 | Rest | | | | | 9 | | 250 | 600 | c.c. | N2 | 1500 | 1.2 h |

TABLE 5-continued

| | | | | | | | | | | | | |
|---|---|---|---|---|---|---|---|---|---|---|---|---|
| 33 | Rest | 1 | 6 | 4 | | 6 | 180 | 420 | c.c. | Ar | 1475 | 1.5 h |
| 34 | Rest | 3 | 7 | | | 10 | 140 | 390 | c.c. | N2 | 1420 | 2.0 h |
| 35 | Rest | 2 | | 1 | 2 | 10 | 80 | 420 | c.c. | Ar | 1450 | 1.0 h |

| | | 2nd sintering | | | Difference to 1st |
|---|---|---|---|---|---|
| Sample No. | Cooling rate (° C./min) | Atm. | Temp. (° C.) | Time | sintering temp. (° C.) |
| *23 | 20 | Vacuum | 1400 | 1.0 h | 150 |
| *24 | 25 | Vacuum | 1375 | 1.0 h | 125 |
| *25 | — | | | — | |
| *26 | 20 | Vacuum | 1250 | 2.0 h | 225 |
| *27 | 20 | Vacuum | 1350 | 1.0 h | 150 |
| 28 | 25 | Vacuum | 1400 | 1.0 h | 150 |
| 29 | 30 | Vacuum | 1380 | 1.5 h | 40 |
| 30 | 20 | Vacuum | 1340 | 1.0 h | 110 |
| 31 | 25 | Vacuum | 1350 | 1.0 h | 175 |
| 32 | 30 | Vacuum | 1390 | 0.5 h | 110 |
| 33 | 25 | Vacuum | 1310 | 1.5 h | 165 |
| 34 | 20 | Vacuum | 1380 | 1.5 h | 40 |
| 35 | 25 | Vacuum | 1340 | 1.0 h | 110 |

Sample numbers marked with * are not within the scope of the present invention.
Mark "c.c" and "s.s." mean "cemented carbide" and "stainless steel", respectively.

Cutting of stainless steel was performed for 15 minutes on the following conditions using the cutting tool obtained, and the flank abrasion loss and the amount to notch damages of a cutting tool were measured. During the cutting examination, in case that a flank abrasion loss amounted to 0.2 mm or the amount of notch damages amounted to 0.5 mm, the cutting time was measured. Furthermore, the edge of a blade of the tool after a cutting examination was observed, and the existence of a deformation or damage was confirmed. The result is shown in Table 6.

(Cutting conditions)

Work piece: stainless steel (SUS304)
Tool shape: SDKN1203AUTN
Cutting rate: 200 m/min.
Feed rate: 0.2 mm/edge
Depth of cut: 2 mm
Other conditions: Dry type cutting

TABLE 6

| | Whole | | Inside of cemented carbide | | | Surface of cemented carbide | | |
|---|---|---|---|---|---|---|---|---|
| Sample No. | Fe ppm | Cr ppm | W1in (Co + Ni)ppm | W2in (Fe + Cr)ppm | Pin (W2in/W1in) | W1suf (Co + Ni)ppm | W2suf (Fe + Cr)ppm | Psuf (W2suf/W1suf) |
| *23 | 2600 | 3600 | 80500 | 7900 | 0.098 | 105000 | 9900 | 0.094 |
| *24 | 4000 | 8000 | 100000 | 12000 | 0.120 | 140000 | 20000 | 0.143 |
| *25 | 200 | 550 | 89000 | 750 | 0.008 | 112000 | 940 | 0.008 |
| *26 | 270 | 420 | 105000 | 690 | 0.007 | 132000 | 850 | 0.007 |
| *27 | 100 | 450 | 99000 | 550 | 0.006 | 145000 | 810 | 0.006 |
| 28 | 70 | 290 | 78000 | 360 | 0.005 | 104000 | 380 | 0.004 |
| 29 | 250 | 340 | 100000 | 590 | 0.006 | 140000 | 620 | 0.004 |
| 30 | 200 | 310 | 99000 | 510 | 0.005 | 120000 | 530 | 0.004 |
| 31 | 180 | 140 | 97000 | 420 | 0.004 | 130000 | 400 | 0.003 |
| 32 | 180 | 740 | 90000 | 920 | 0.010 | 101000 | 940 | 0.009 |
| 33 | 50 | 590 | 61000 | 640 | 0.010 | 71000 | 650 | 0.009 |
| 34 | 190 | 400 | 99000 | 590 | 0.006 | 120000 | 590 | 0.005 |
| 35 | 130 | 380 | 98000 | 510 | 0.005 | 118000 | 500 | 0.004 |

| | | Cutting Evaluation | | |
|---|---|---|---|---|
| Sample No. | Psuf/Pin | Flank wear mm (min) | Notch wear mm (min) | Welding & Adhesion |
| *23 | 0.96 | 0.25 | 0.44 | Large |
| *24 | 1.19 | Deficit(8 min) | — | Large |
| *25 | 1.00 | Deficit(5 min) | — | Large |
| *26 | 0.99 | 0.28(14 min) | >0.5(14 min) | Large |
| *27 | 1.01 | >0.3(12 min) | 0.5(12 min) | Large |
| 28 | 0.79 | 0.15 | 0.2 | No |
| 29 | 0.75 | 0.1 | 0.15 | No |
| 30 | 0.86 | 0.12 | 0.16 | No |
| 31 | 0.71 | 0.16 | 0.22 | Small |
| 32 | 0.91 | 0.2 | 0.23 | No |

TABLE 6-continued

| | | | | |
|---|---|---|---|---|
| 33 | 0.87 | 0.19 | 0.21 | Small |
| 34 | 0.83 | 0.2 | 0.22 | No |
| 35 | 0.81 | 0.18 | 0.25 | No |

Sample numbers marked with * are not within the scope of the present invention.

As is apparent from the result of Tables 5 and 6, in sample No. 23 with high contents of the iron in a raw material (Fe), and sample No. 24 using stainless steel as grinding media and a churning arm, the content of the iron in the entire cemented carbide (Fe) was over 300 ppm. Accordingly, after a hard coat wears out and cemented carbide is exposed during cutting, abrasion advanced rapidly and the tool life has been reached.

At sample No. 25 which sintered the pattern (one-step sintering) retained only with the 1st sintering temperature, and sample No.26 by which the difference of the 1st sintering temperature and the 2nd sintering temperature exceeds 200° C., the content ration of iron (Fe) and chromium (Cr) to the cobalt (Co) and/or nickel (Ni) in the surface became more than equivalent, all had the remarkable welding and adhesion of workpiece, and machinability fell.

In sample No. 27 which performed both the retention with the 1st sintering temperature, and the retention with the 2nd sintering temperature in the vacuum, $P_{suf}/P_{in}$ was about 1.0, there was no difference in the presence ratio of (iron+chromium) and (cobalt+nickel) between the surface and the inside. Since there were high amounts of formation of the embrittlement phase in the surface compared with this invention, the adhesion force of a hard coat declined and peeling of a coat occurred during cutting. Consequently, the amount of abrasion loss increased and a large amount of welding things adhered to the piece edge of a cutting tool.

On the other hand, each sample Nos. 28–35 according to this invention had the excellent wear resistance with a flank abrasion loss of 0.2 mm or less (processing time/15 min.).

Example IV

The 3rd Cemented Carbide

About sample Nos. 24, 34, and 35, the hard coat was formed on the surface by PVD with the material and thickness shown in Table 7, and the cutting examination was performed on the same conditions as the above.

On the other hand, in sample Nos. 34-1, 2 and 3 that used sample No. 34 according to this invention as the base metal, and sample No. 35-1 that used sample No. 35 according to this invention as the base metal, a hard coat did not peel and there also happened little welding of workpiece.

Example V

4th Cemented Carbide

Tungsten-carbide (WC) powder of 1.5 μm of mean particle diameters, the metal cobalt (Co) powder of 1.2 μm of mean particle diameters and the compound powder of a metallic element M shown in Table 0 of 2.0 μm of mean particle diameters were added and mixed by the ratio shown in Table 8.

After molding the mixture by the press forming in cutting tool shape (CNMC120408), debinder processing was performed. Furthermore, the temperature up of the 1000° C. or more was carried out at the rate or 3° C./min., and cemented carbide was produced by sintering at 1500° C. for 1 hour among the 0.01 Pa vacuum.

A surface coated cemented carbide was produced by forming a hard coating on the surface of the obtained cemented carbide by CVD in order with TiN of 1 μm, TiCN of 7 μm, Al2O3 of 3 μm and TiN of 1 μm.

Concerning the obtained surface coating cemented carbide, the metallic element concentration distribution was measured at the arbitrary region of 200 μm×200 μm from the surface toward the inside by the wavelength-dispersion type X-ray microanalyser (EPMA). In the EPMA measurement, the surface region of the test piece was ground in the direction of slant. Subsequently, five concentration distributions were measured for every depth of 5 μm from the surface, and the average was calculated. The concentration distribution as shown in FIG. 5(*b*) from the metallic element concentration distribution was mapped, and the thickness of the 1st surface region and the 2nd surface region was calculated. The result is shown in FIG. 5(*b*) and Table 8.

TABLE 7

| Sample | Surface layer (μm) | | | Adhesive strength | Cutting evaluation | | |
|---|---|---|---|---|---|---|---|
| No. | TIN | TiCN | TiAIN | [N] | Flank abrasion mm (min) | Welding & Adhesion | Peeling of hard coat |
| *24-1 | 2 | — | — | 20 | 0.5 | Large | Yes |
| 34-1 | 2 | — | — | 70 | 0.18 | Small | No |
| 34-2 | — | — | 2.5 | 80 | 0.1 | No | No |
| 34 3 | | 1.5 | 1.5 | 65 | 0.12 | Small | No |
| 35-1 | — | 2.5 | — | 70 | 0.15 | No | No |

Sample numbers marked with * are not within the scope of the present invention.

As is apparent from Table 7, in sample No. 24-1 that used sample 24 with high iron contents as the base metal, the hard coat break away and workpiece carried out the welding to the tool surface so much.

Moreover, samples was oxidized for 30 minutes at 800° C. under the air atmosphere, and the increase weight before and after oxidation was defined as oxidation resistance. The results are shown in Table 8.

TABLE 8

| Sample No. | Composition(wt %) WC | Co | TiC | TaC | NbC | ZrC | HfC | VC | $Cr_3C_2$ | Nb/ (V + Nb + Ta) | Zr/ (Ti + Zr + Hf) |
|---|---|---|---|---|---|---|---|---|---|---|---|
| *36 | 88 | 6 | 2 | 2 | — | 2 | — | — | — | — | 0.37 |
| *37 | 86 | 8 | 2 | — | 2 | — | 2 | — | — | 1.00 | — |
| 38 | 88.5 | 6 | 2 | — | 3 | 0.5 | — | — | — | 1.00 | 0.13 |
| 39 | 88 | 6 | 2 | 0.5 | 3 | 0.5 | — | — | — | 0.92 | 0.13 |
| 40 | 86.4 | 8 | 2 | — | 2 | 1 | — | 0.5 | 0.1 | 0.71 | 0.22 |
| 41 | 86.5 | 8 | 2 | 0.5 | 2 | 1 | — | — | — | 0.88 | 0.22 |
| 42 | 85.5 | 10 | 2 | — | 1 | 1.5 | — | — | — | 1.00 | 0.30 |
| 43 | 85 | 10 | 2 | 0.5 | 1 | 1.5 | — | — | — | 0.79 | 0.30 |

| Sample No. | Zr/ (Nb + Zr) | 1st surface layer $p_{suf}/p_{in}$ | $q_{suf}/q_{in}$ | $d_1$ | 2nd surface layer $p_{suf}/p_{in}$ | $q_{suf}/q_{in}$ | $d_2$ | $d_1/d_2$ | Oxidation resistance ($mg/mm^2$) |
|---|---|---|---|---|---|---|---|---|---|
| *36 | 1.00 | 0.5 | 0.4 | — | 1.3 | 0.9 | — | — | 0.025 |
| *37 | — | 1.1 | — | — | 0.9 | — | — | — | 0.017 |
| 38 | 0.14 | 0.3 | 1.0 | 20 | 1.1 | 1.0 | 50 | 0.40 | 0.001 |
| 39 | 0.14 | 0.5 | 1.1 | 5 | 1.2 | 1.1 | 25 | 0.20 | 0.001 |
| 40 | 0.34 | 0.2 | 1.0 | 10 | 1.0 | 1.0 | 30 | 0.33 | 0.002 |
| 41 | 0.34 | 0.2 | 0.9 | 15 | 1.0 | 0.9 | 70 | 0.21 | 0.003 |
| 42 | 0.60 | 0.4 | 1.1 | 5 | 1.1 | 1.1 | 10 | 0.50 | 0.001 |
| 43 | 0.60 | 0.3 | 1.0 | 40 | 1.2 | 1.0 | 120 | 0.33 | 0.003 |

Sample numbers marked with * are not within the scope of the present invention.

Cutting of alloy steel was performed for 23 minutes on the following conditions using the cutting tool (test piece) obtained, and the flank abrasion loss and the tip abrasion loss of a cutting tool were measured. During the cutting examination, in case that a flank abrasion loss or the tip abrasion loss amounted to 0.2 mm, the cutting time was measured. Furthermore, when performing an intermittence cutting examination with steel materials (workpiece) with a slot, the number of impacts suffering a loss was counted. The results are shown in Table 9.

(Abrasion test)
Work piece: alloy-steel (SCN435)
Tool shape: CNMG120408
Cutting rate: 250 m/min.
Feed rate: 0.3 mm/rev
Depth of cut: 2 mm
Other conditions: with water-soluble cutting liquid
(intermittence cutting examination)
Work piece: alloy steel (SCN440)
Tool shape: CNMG120408
Cutting rate: 200 m/min.
Feed rate: 0.4 mm/rev
Depth of cut: 1.5 mm
Other conditions: with water-soluble cutting liquid

TABLE 9

| Sample No. | Flank wear (mm) | Nose wear (mm) | Number of impacts until failure (times) |
|---|---|---|---|
| *36 | 0.27 | 0.34 | 2600 |
| *37 | 0.19 | 0.18 | 1500 |
| 38 | 0.16 | 0.12 | 4000 |
| 39 | 0.15 | 0.14 | 4500 |
| 40 | 0.18 | 0.15 | 4200 |
| 41 | 0.17 | 0.16 | 4800 |
| 42 | 0.18 | 0.17 | 3900 |
| 43 | 0.12 | 0.12 | 5200 |

Sample numbers marked with * are not within the scope of the present invention.

As is apparent from the results of Tables 8 and 9, in sample No. 36 which do not contain Nb, $q_{1suf}/q_{in}$ (content ratio of Zr) in the 1st surface region became smaller than 0.9, for this reason, oxidation resistance fall, and machinability fall. When the cross sectional observation of the test piece by SEM after an oxidation test was carried out, it confirmed that near the base-metal surface deteriorated by oxidation. In sample No. 37 which do not contain Zr, $p_{1suf}/p_{in}$ (the total content ratio of a metallic element M) in the 1st surface region was larger than 0.9, and $q_{1suf}/q_{in}$ (content ratio of Zr) became small from 0.9.

Moreover, $p_{2suf}/p_{in}$ (the total content ratio of a metallic element M) in the 2nd surface region became smaller than 1.1, and $q_{2suf}/q_{in}$ (content ratio of Zr) became smaller than 0.9, for this reason, fracture resistance and oxidation resistance were bad.

On the other hand, each sample Nos. 36–43 according to this invention, by which both Zr and Nb added, which possess the 1st surface region of $0.1 \leqq p_{1suf}/p_{in} \leqq 0.9$, $0.9 \leqq q_{1suf}/q_{in} \leqq 1.1$, $1.1 \leqq p_{2suf}/p_{in} \leqq 1.5$ and $0.9 \leqq q_{2suf}/q_{in} \leqq 1.1$, and the 2nd surface region located inside the 1st surface region were excellent in oxidation resistance, had high hardness and high toughness, and had the excellent machinability.

Example VI

4th Cemented Carbide

About sample Nos. 37 and 42 of Example V, the cutting tool which consists of surface coating cemented carbide was produced in the same manner as Example V, except for sintering at 1400° C. for 1 hour, after molding in the cutting tool shape for milling (SDK42), and forming the TiN film of 2 μm of thickness by PVD on the surface of the cutting tool.

Stainless steel was cut for 15 minutes on the following conditions using the obtained cutting tool, and machinability was evaluated in the same manner as Example 1.
Work piece: stainless steel (SUS304)
Tool shape: SDK42
Cutting rate: 200 m/min.
Feed rate: 0.2 mm/edge
Depth of cut: 2 mm Other conditions: with water-soluble cutting liquid As a result, the flank abrasion lose of sample No. 37 was 0.21 mm. On the other hand, the flank abrasion loss of sample No. 42 was 0.11 mm. Accordingly, it is understood that sample No. 42 have the excellent wear resistance and excellent fracture resistance.

What is claimed is:

1. A cemented carbide comprising a hard phase component which comprises a tungsten carbide WC and at least one selected from carbides, nitrides and carbonitrides of metals of the groups 4a, 5a and 6a in the Periodic Table; and a binder phase component comprising at least one of iron-group metals, wherein the surface region of the cemented carbide has 90–98% of the minimum hardness as compared with internal hardness.

2. The cemented carbide according to claim 1, which comprises a hard phase component comprising a tungsten carbide and at least one selected from carbide, nitrides and carbonitrides of metals selected from the groups 4a, 5a and 6a in the periodic table; and a binder-phase component comprising at least one of iron-group metals, wherein metals selected from the groups 4a, 5a and 6a of the periodic table contains Zr at least, and a region where the content ratio of Zr in metals selected from the groups 4a, 5a and 6a in the periodic table is high as compared with the inside of the cemented carbide is formed near the surface of the cemented carbide.

3. The cemented carbide according to claim 2, wherein the region where the content ratio of Zr is high as compared with inside is the surface region defined in claim 1.

4. The Cemented carbide according to claim 2 wherein thickness of the region where the content ratio of Zr is high as compared with inside is 5 to 100 $\mu$m.

5. The cemented carbide according to claim 2, wherein two or more B1 type solid solution phases exist in the inside of the cemented carbide, and one of them is B1 type solid solution phase with high contents of Zr as compared with other B1 type solid solution phases.

6. The cemented carbide according to claim 2, wherein a B1 type solid solution phase with high contents of Zr exists in the inside of the cemented carbide, wherein the mean particle diameter of said B1 solid solution phase with high contents of Zr is 3 $\mu$m or less.

7. The cemented carbide according to claim 1 wherein a content rate of Ta in said hard phase component is 1% by weight or less in TaC conversion.

8. A cemented carbide comprising a WC phase, at least two solid solution selected from carbides, nitrides and carbonitrides of metals selected from the groups 4a, 5a and 6a in the periodic table and containing Zr and Nb at least, and a binder phase containing at least one of iron-group metals, wherein the cemented carbide has the 1st phase having a peak in 2 $\theta$=40.00–41.99° and the 2nd phase having a peak in 2 $\theta$=38.00–39.99° in the X-ray diffraction of the cemented carbide.

9. The cemented carbide according to claim 8, wherein ratio (p2/P1) of the strength (p1) of the 1st peak and the strength (p2) of the 2nd peak is 0.1 to 2.

10. The cemented carbide according to claim 8, wherein content ratio (Zr/Zr+Nb) of Zr and Nb is 0.5 to 0.7.

11. The cemented carbide according to claim 8, wherein content of Ta is 1% by weight or less by TaC conversion in said at least two solid solution.

12. The cemented carbide according to claim 8, wherein the tungsten-carbide phase is contained at the ratio of 60 to 95 volume % of total cemented carbide volume.

13. The cemented carbide according to claim 8, wherein the binder phase is contained at the ratio of 1 to 20 volume % of total cemented carbide volume.

14. The cemented carbide according to claim 8, wherein the strength of the peak in the 2nd phase (p2)>0 and the strength of the peak in the 1st phase (p1)=0 in the surface of the cemented carbide.

15. A cemented carbide comprising 2 to 20% by weight of a binder metal comprising at least one of cobalt (Co) and nickel (Ni), 0 to 30% by weight of at least one selected from carbides, nitrides and carbonitrides of metals of the groups 4a, 5a and 6a in the periodic table, 10 to 300 ppm of iron (Fe), 100 to 1000 ppm of chromium (Cr), and tungsten carbide and unescapable impurities as remainder, wherein, a surface region satisfies the conditions of $p_{suf}<p_{in}$ wherein $p_{suf}$ and $p_{in}$ are defined below:

$p_{in}=w_{2in}/w_{1in}$ $p_{suf}=w_{2suf}/w_{1suf}$ $w_{1in}$: content ratio of the binder metal inside the cemented carbide $w_{2in}$: content ratio of Fe and Cr inside the cemented carbide $w_{2suf}$: content ratio of the binder metal in the surface region of the cemented carbide $w_{1suf}$: content ration of Fe and Cr in the surface region of the cemented carbide.

16. The cemented carbide according to claim 15 wherein maximum of a ratio ($p_{suf}/p_{in}$) with the $p_{suf}$ and $p_{in}$ in the surface region is 0.5 to 0.96.

17. The cemented carbide according to claim 15, wherein thickness of the surface region is 1 to 20 $\mu$m.

* * * * *